US011041496B2

(12) United States Patent
Cheah et al.

(10) Patent No.: US 11,041,496 B2
(45) Date of Patent: Jun. 22, 2021

(54) PARTICLE GUARD RING FOR MIXED FLOW PUMP

(71) Applicant: SCHLUMBERGER TECHNOLOGY CORPORATION, Sugar Land, TX (US)

(72) Inventors: Kean Wee Cheah, Singapore (SG); David Milton Eslinger, Collinsville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 455 days.

(21) Appl. No.: 15/740,679

(22) PCT Filed: Jun. 30, 2015

(86) PCT No.: PCT/US2015/038511
§ 371 (c)(1),
(2) Date: Dec. 28, 2017

(87) PCT Pub. No.: WO2017/003449
PCT Pub. Date: Jan. 5, 2017

(65) Prior Publication Data

US 2018/0195514 A1 Jul. 12, 2018

(51) Int. Cl.
*F04D 13/10* (2006.01)
*F04D 1/06* (2006.01)
(Continued)

(52) U.S. Cl.
CPC ..... *F04D 13/10* (2013.01); *F04D 1/06* (2013.01); *F04D 7/04* (2013.01); *F04D 13/021* (2013.01);
(Continued)

(58) Field of Classification Search
None
See application file for complete search history.

(56) References Cited

U.S. PATENT DOCUMENTS 4,838,758 A 6/1989 Sheth
6,106,224 A * 8/2000 Sheth ..... F04D 29/0413 415/104
(Continued)

FOREIGN PATENT DOCUMENTS

WO 2015-038616 A1 3/2015

OTHER PUBLICATIONS

International Search Report and Written Opinion issued in the PCT Application PCT/US2015/038511, dated Mar. 10, 2016 (10 pages).
(Continued)

*Primary Examiner* — Ninh H. Nguyen
*Assistant Examiner* — Jason Fountain

(57) ABSTRACT

A mixed-flow impeller for an electric submersible pump can include a lower end and an upper end; a hub that includes a through bore that defines an axis; blades that extend at least in part radially outward from the hub where each of the blades includes a leading edge and a trailing edge; an upper balance ring that includes a radially inward facing balance chamber surface and a radially outward facing diffuser clearance surface; and an upper guard ring disposed radially outwardly from the upper balance ring where the upper guard ring includes an axially facing diffuser clearance surface that is disposed axially between the trailing edges of the blades and the upper end.

17 Claims, 16 Drawing Sheets

(51) Int. Cl.

| | |
|---|---|
| ***F04D 7/04*** | (2006.01) |
| ***F04D 29/041*** | (2006.01) |
| ***F04D 29/70*** | (2006.01) |
| ***F04D 13/02*** | (2006.01) |
| ***F04D 29/08*** | (2006.01) |
| ***F04D 29/22*** | (2006.01) |

(52) U.S. Cl.
CPC ..... *F04D 29/0413* (2013.01); *F04D 29/708* (2013.01); *F04D 29/086* (2013.01); *F04D 29/2272* (2013.01)

(56) References Cited

U.S. PATENT DOCUMENTS

| | | | | |
|---|---|---|---|---|
| 6,234,748 | B1 | 5/2001 | Brown et al. | |
| 6,676,366 | B2 * | 1/2004 | Kao | F04D 29/2288 415/1 |
| 10,161,411 | B1 * | 12/2018 | Gottschalk | F04D 1/063 |
| 10,451,079 | B2 * | 10/2019 | Chang | E21B 43/2406 |
| 2003/0170112 | A1 * | 9/2003 | Kao | F04D 29/2288 415/1 |
| 2011/0255951 | A1 | 10/2011 | Song et al. | |
| 2012/0020777 | A1 * | 1/2012 | Eslinger | F04D 1/063 415/170.1 |
| 2013/0209225 | A1 | 8/2013 | Eslinger | |
| 2017/0167498 | A1 * | 6/2017 | Chang | F04D 29/20 |

OTHER PUBLICATIONS

International Preliminary Report on Patentability issued in the PCT Application PCT/US2015/038511, dated Jan. 2, 2018 (6 pages).

* cited by examiner

PARTICLE GUARD RING FOR MIXED FLOW PUMP

BACKGROUND

An electric submersible pump (ESP) can include a stack of impeller and diffuser stages where the impellers are operatively coupled to a shaft driven by an electric motor.

SUMMARY

A mixed-flow impeller for an electric submersible pump can include a lower end and an upper end; a hub that includes a through bore that defines an axis; blades that extend at least in part radially outward from the hub where each of the blades includes a leading edge and a trailing edge; an upper balance ring that includes a radially inward facing balance chamber surface and a radially outward facing diffuser clearance surface; and an upper guard ring disposed radially outwardly from the upper balance ring where the upper guard ring includes an axially facing diffuser clearance surface that is disposed axially between the trailing edges of the blades and the upper end. A mixed-flow impeller for an electric submersible pump can include a lower end and an upper end; a hub that includes a through bore that defines an axis; a lower shroud ring that extends to a shroud wall; blades that extend at least in part radially outward from the hub to the shroud wall where each of the blades includes a leading edge and a trailing edge; a lower guard ring disposed radially outwardly from the lower shroud ring where the lower guard ring includes an axially facing diffuser clearance surface that is disposed axially between the leading edges of the blades and the lower end. A mixed-flow impeller and diffuser assembly for an electric submersible pump can include an impeller that includes a lower end and an upper end, a hub that includes a through bore that defines an axis, blades that extend at least in part radially outward from the hub where each of the blades includes a leading edge and a trailing edge, an upper balance ring that includes a radially inward facing balance chamber surface and a radially outward facing diffuser clearance surface, and an upper guard ring disposed radially outwardly from the upper balance ring where the upper guard ring includes an axially facing diffuser clearance surface that is disposed axially between the trailing edges of the blades and the upper end; and a diffuser that includes a lower end and an upper end, a hub that includes a through bore that defines an axis, and vanes that extend at least in part radially outward from the hub where each of the vanes includes a leading edge and a trailing edge. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
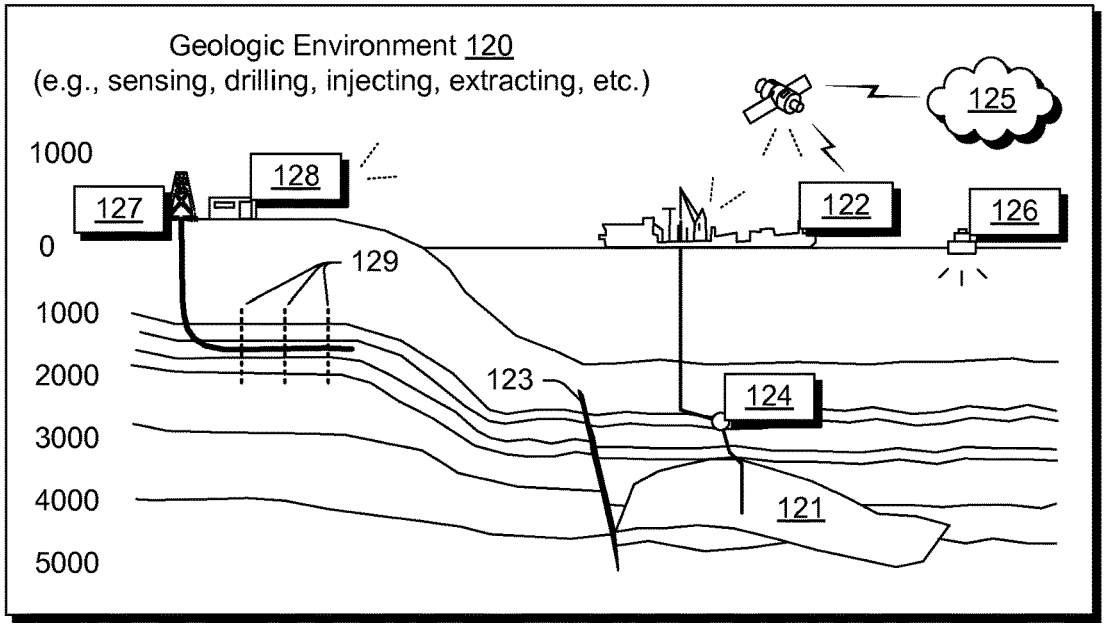
FIG. 1 illustrates examples of equipment in geologic environments.
Figure 1:
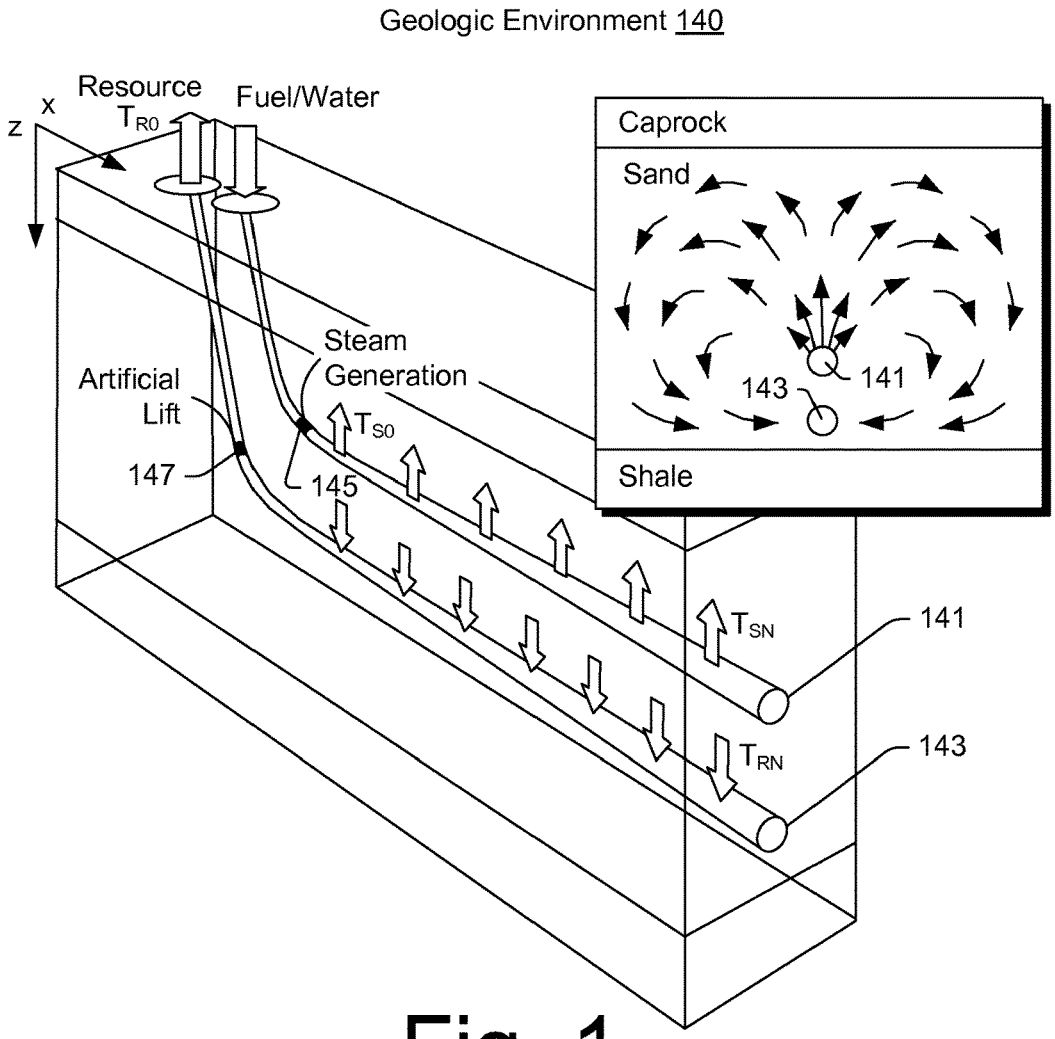

FIG. 1 shows examples of geologic environments 120 and 140. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, etc.

As to the geologic environment 140, as shown in FIG. 1, it includes two wells 141 and 143 (e.g., bores), which may be, for example, disposed at least partially in a layer such as a sand layer disposed between caprock and shale. As an example, the geologic environment 140 may be outfitted with equipment 145, which may be, for example, steam assisted gravity drainage (SAGD) equipment for injecting steam for enhancing extraction of a resource from a reservoir. SAGD is a technique that involves subterranean delivery of steam to enhance flow of heavy oil, bitumen, etc. SAGD can be applied for Enhanced Oil Recovery (EOR), which is also known as tertiary recovery because it changes properties of oil in situ.

As an example, a SAGD operation in the geologic environment 140 may use the well 141 for steam-injection and the well 143 for resource production. In such an example, the equipment 145 may be a downhole steam generator and the equipment 147 may be an electric submersible pump (e.g., an ESP).

As illustrated in a cross-sectional view of FIG. 1, steam injected via the well 141 may rise in a subterranean portion of the geologic environment and transfer heat to a desirable resource such as heavy oil. In turn, as the resource is heated, its viscosity decreases, allowing it to flow more readily to the well 143 (e.g., a resource production well). In such an example, equipment 147 (e.g., an ESP) may then assist with lifting the resource in the well 143 to, for example, a surface facility (e.g., via a wellhead, etc.). As an example, where a production well includes artificial lift equipment such as an ESP, operation of such equipment may be impacted by the presence of condensed steam (e.g., water in addition to a desired resource). In such an example, an ESP may experience conditions that may depend in part on operation of other equipment (e.g., steam injection, operation of another ESP, etc.).

Conditions in a geologic environment may be transient and/or persistent. Where equipment is placed within a geologic environment, longevity of the equipment can depend on characteristics of the environment and, for example, duration of use of the equipment as well as function of the equipment. Where equipment is to endure in an environment over an extended period of time, uncertainty may arise in one or more factors that could impact integrity or expected lifetime of the equipment. As an example, where a period of time may be of the order of decades, equipment that is intended to last for such a period of time may be constructed to endure conditions imposed thereon, whether imposed by an environment or environments and/or one or more functions of the equipment itself.

Figure 2:
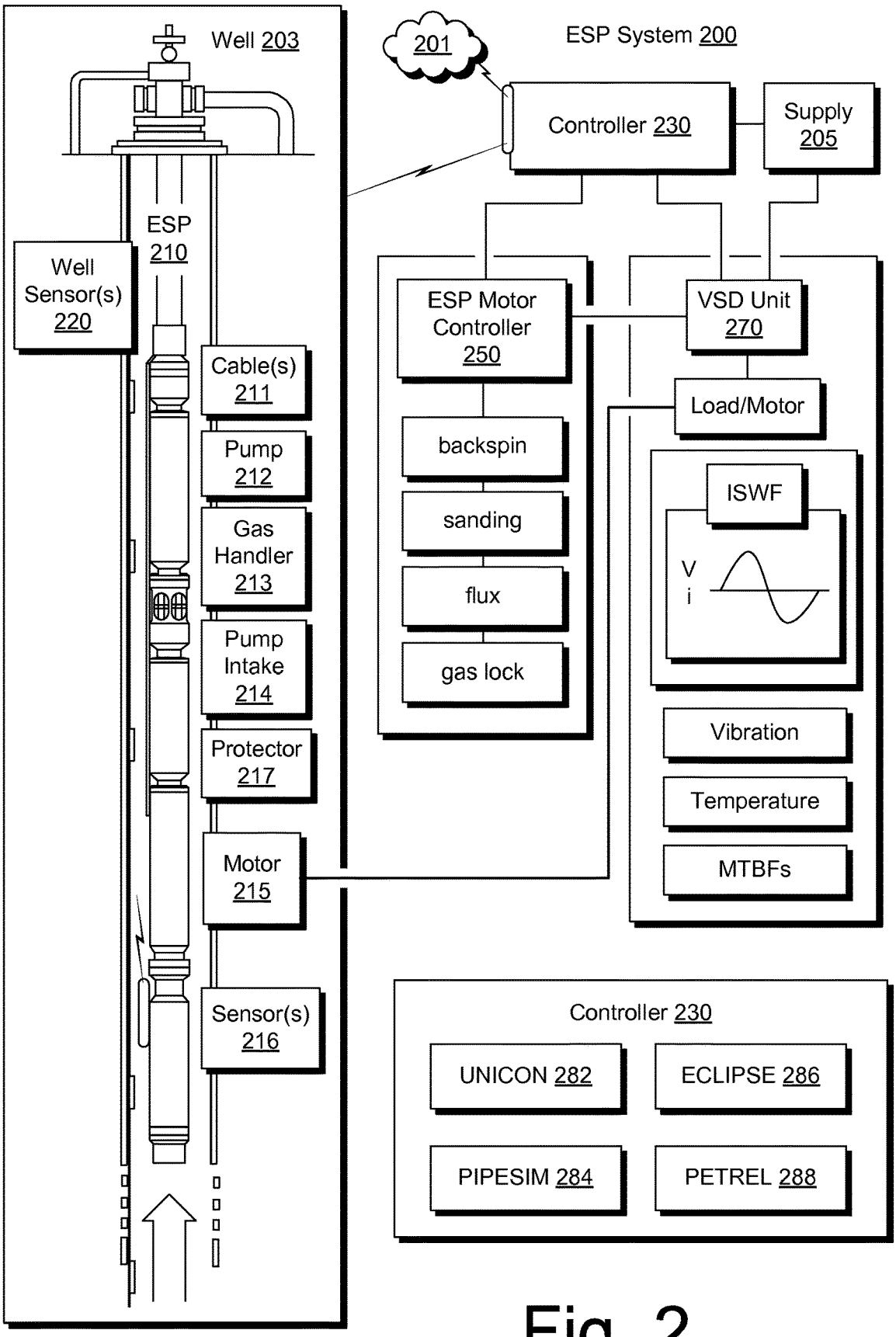
FIG. 2 illustrates an example of an electric submersible pump system.

FIG. 2 shows an example of an ESP system 200 that includes an ESP 210 as an example of equipment that may be placed in a geologic environment. As an example, an ESP may be expected to function in an environment over an extended period of time (e.g., optionally of the order of years). As an example, commercially available ESPs (such as the REDA™ ESPs marketed by Schlumberger Limited, Houston, Tex.) may find use in various pumping applications. As an example, an ESP may include a housing that has an outer diameter of about several inches to about ten inches or more. For example, consider an ESP that includes a shaft with a diameter of about 2 cm and a housing with an outer diameter of about 10 cm.

In the example of FIG. 2, the ESP system 200 includes a network 201, a well 203 disposed in a geologic environment (e.g., with surface equipment, etc.), a power supply 205, the ESP 210, a controller 230, a motor controller 250 and a VSD unit 270. The power supply 205 may receive power from a power grid, an onsite generator (e.g., natural gas driven turbine), or other source.

As shown, the well 203 includes a wellhead that can include a choke (e.g., a choke valve). For example, the well 203 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc. As an example, solids can include particles such as, for example, sand particles (e.g., sand).

As to the ESP 210, it is shown as including cables 211 (e.g., or a cable), a pump 212, gas handling features 213, a pump intake 214, a motor 215, one or more sensors 216 (e.g., temperature, pressure, strain, current leakage, vibration, etc.) and optionally a protector 217.

As an example, an ESP may include a REDA™ HOTLINE™ high-temperature ESP motor. Such a motor may be suitable for implementation in a thermal recovery heavy oil production system, such as, for example, SAGD system or other steam-flooding system.

As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper (e.g., or other conductive material) and insulation.

In the example of FIG. 2, the well 203 may include one or more well sensors 220, for example, such as the commercially available OPTICLINE™ sensors or WELLWATCHER BRITEBLUE™ sensors marketed by Schlumberger Limited (Houston, Tex.). Such sensors are fiber-optic based and can provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend thousands of feet into a well and beyond a position of an ESP.

In the example of FIG. 2, the controller 230 can include one or more interfaces, for example, for receipt, transmission or receipt and transmission of information with the motor controller 250, a VSD unit 270, the power supply 205 (e.g., a gas fueled turbine generator, a power company, etc.), the network 201, equipment in the well 203, equipment in another well, etc.

As shown in FIG. 2, the controller 230 may include or provide access to one or more modules or frameworks. Further, the controller 230 may include features of an ESP motor controller and optionally supplant the ESP motor controller 250. For example, the controller 230 may include the UNICONN™ motor controller 282 marketed by Schlumberger Limited (Houston, Tex.). In the example of FIG. 2, the controller 230 may access one or more of the PIPESIM™ framework 284 marketed by Schlumberger Limited (Houston, Tex.), the ECLIPSE™ framework 286 marketed by Schlumberger Limited (Houston, Tex.) and the PETREL™ framework 288 marketed by Schlumberger Limited (Houston, Tex.) (e.g., and optionally the OCEAN™ framework marketed by Schlumberger Limited (Houston, Tex.)).

In the example of FIG. 2, the motor controller 250 may be a commercially available motor controller such as the UNICONN™ motor controller. The UNICONN™ motor controller can connect to a SCADA system, the ESP-WATCHER™ surveillance system, etc. The UNICONN™ motor controller can perform some control and data acquisition tasks for ESPs, surface pumps or other monitored wells. The UNICONN™ motor controller can interface with the PHOENIX™ monitoring system, for example, to access pressure, temperature and vibration data and various protection parameters as well as to provide direct current power to downhole sensors. The UNICONN™ motor controller can interface with fixed speed drive (FSD) controllers or a VSD unit, for example, such as the VSD unit 270.

For FSD controllers, the UNICONN™ motor controller can monitor ESP system three-phase currents, three-phase surface voltage, supply voltage and frequency, ESP spinning frequency and leg ground, power factor and motor load.

For VSD units, the UNICONN™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 2, the ESP motor controller 250 includes various modules to handle, for example, backspin of an ESP, sanding of an ESP (e.g., to mitigate solids collection, blocking, etc.), flux of an ESP and gas lock of an ESP. The motor controller 250 may include any of a variety of features, additionally, alternatively, etc.

In the example of FIG. 2, the VSD unit 270 may be a low voltage drive (LVD) unit, a medium voltage drive (MVD) unit or other type of unit (e.g., a high voltage drive, which may provide a voltage in excess of about 4.16 kV). As an example, the VSD unit 270 may receive power with a voltage of about 4.16 kV and control a motor as a load with a voltage from about 0 V to about 4.16 kV. The VSD unit 270 may include commercially available control circuitry such as the SPEEDSTAR™ MVD control circuitry marketed by Schlumberger Limited (Houston, Tex.). As an example, a drive unit may be rated to receive input in a range of voltages, for example, from a few hundred volts to more than ten thousand volts and be rated to output a range of voltages, for example, from about zero to about four thousand or more. As an example, a drive unit may be rated with an operational frequency range for output such as, for example, from about zero hertz to about one hundred hertz or more (e.g., consider the SPEEDSTAR™ MVD VSD, etc.).

Figure 3:
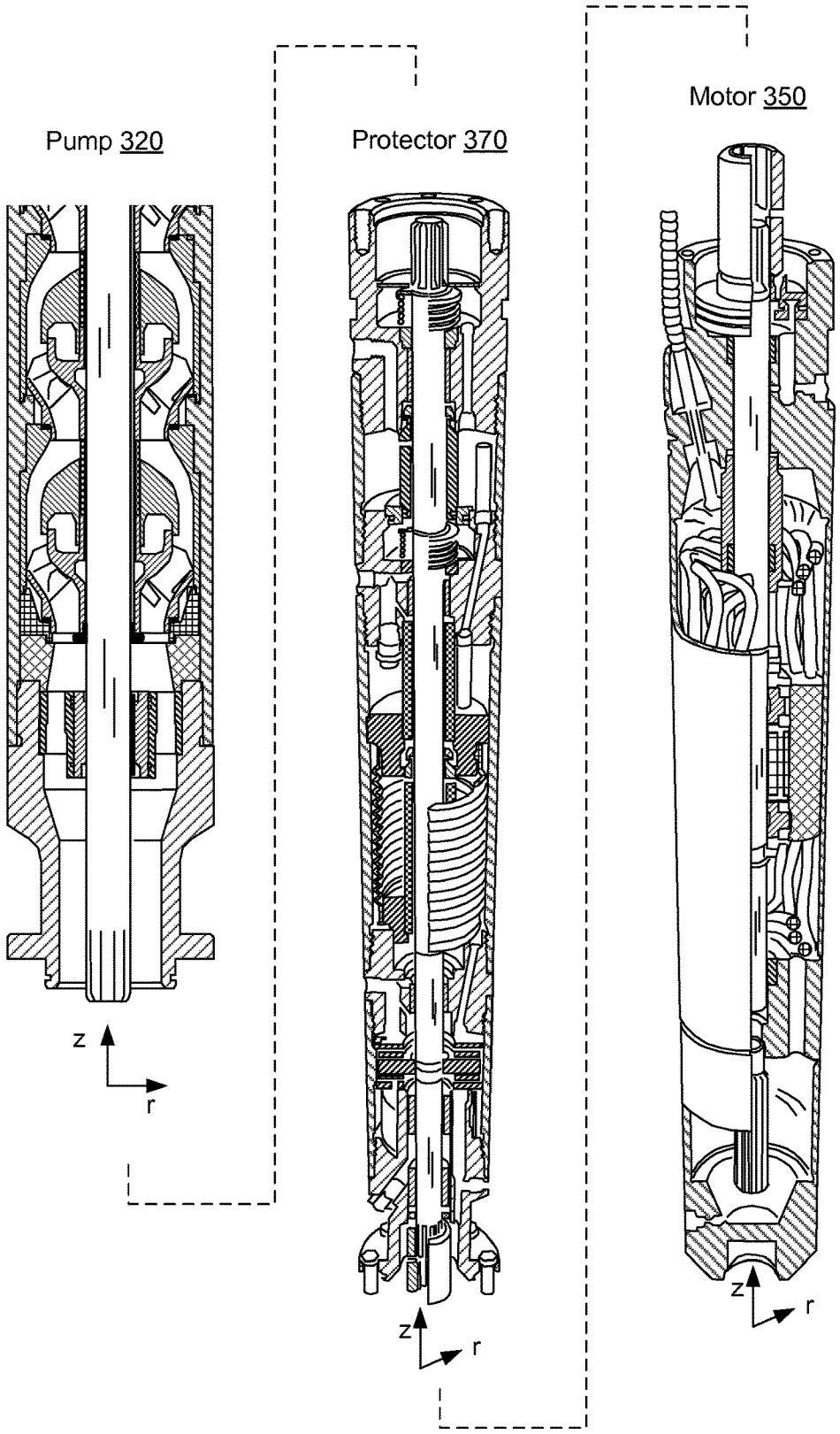
FIG. 3 illustrates examples of equipment.

FIG. 3 shows cut-away views of examples of equipment such as, for example, a portion of a pump 320, a protector 370 and a motor 350 (see, e.g., the pump 212, the protector 217 and the motor 215 of FIG. 2). In FIG. 3, the pump 320, the protector 370 and the motor 350 are shown with respect to cylindrical coordinate systems (e.g., r, z, Θ). Various features of equipment may be described, defined, etc., with respect to a cylindrical coordinate system. As an example, a lower end of the pump 320 may be coupled to an upper end of the protector 370 and a lower end of the protector 370 may be coupled to an upper end of the motor 350. As shown in FIG. 3, a shaft segment of the pump 320 may be coupled via a connector to a shaft segment of the protector 370 and the shaft segment of the protector 370 may be coupled via a connector to a shaft segment of the motor 350. As an example, an ESP may be oriented in a desired direction, which may be vertical, horizontal or other angle. Orientation of an ESP with respect to gravity may be considered as a factor, for example, to determine ESP features, operation, etc.

Figure 4:
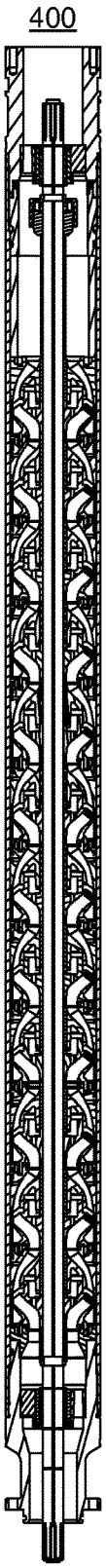
FIG. 4 illustrates an example of a pump, an example of an impeller and examples of component of the pump.
Figure 4:
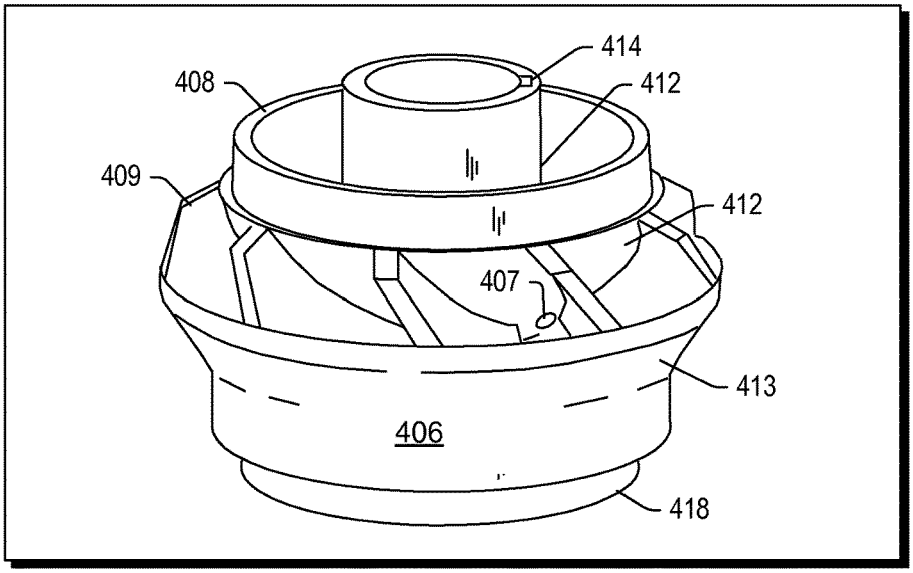
Figure 4:
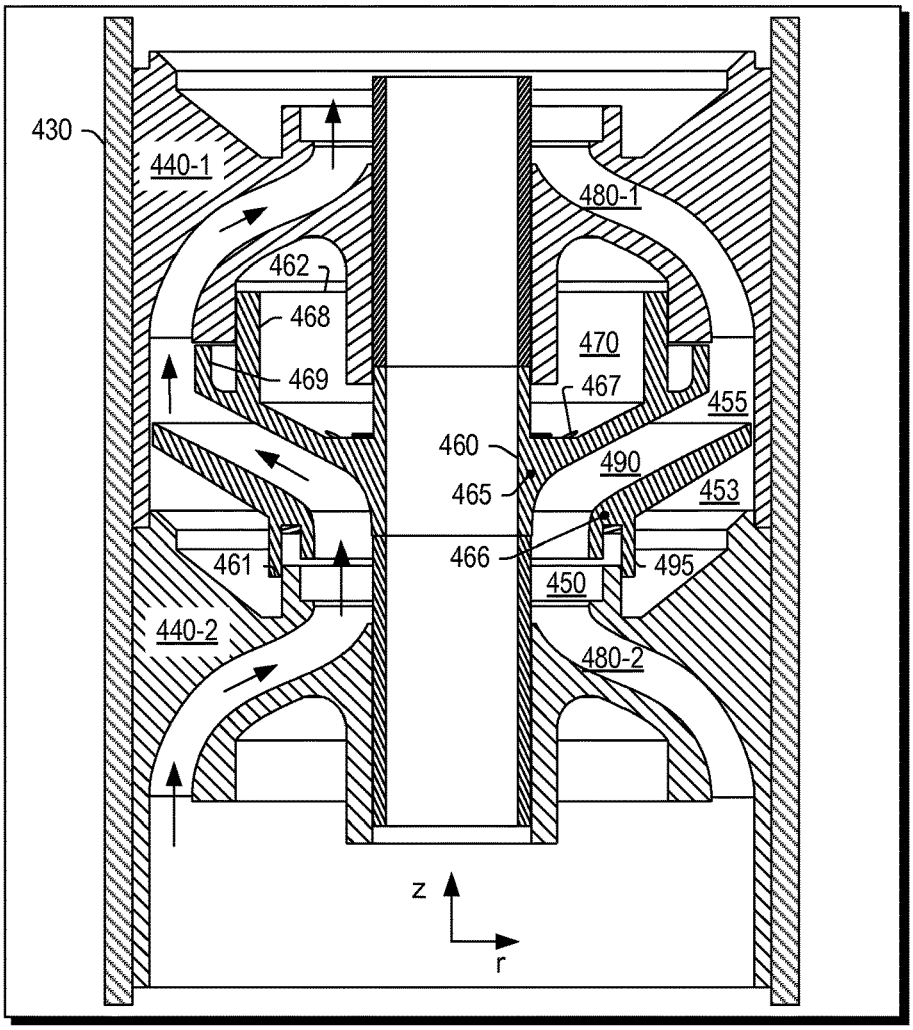

FIG. 4 shows a cut-away view of a pump 400 that includes a stack of impeller and diffuser stages where the impellers are operatively coupled to a shaft that may be driven by an electric motor (see, e.g., the electric motor 350 of FIG. 3). In such a pump, various forces exist during operation as fluid is propelled from lower stages to upper stages of a stack. As an example, a pump may be oriented vertically, horizontally or at an angle between vertical and horizontal with respect to an environment. In such an example, vertical may be aligned substantially with gravity.

FIG. 4 also shows a perspective view of an example of an impeller 406 that includes balance holes 407, an upper balance ring 408, impeller blades 409, a hub portion 412 (e.g., a hub), a shroud portion 413 (e.g., a shroud), a keyway 414 and a lower balance ring 418. As an example, a shaft may be inserted in a bore of the hub portion 412 where a key is disposed at least in part in a keyway of the shaft and at least in part in the keyway 414 of the hub portion 412 of the impeller 406. In such a manner, rotation of the shaft can cause rotation of the impeller 406 and, for example, the impeller 406 may move axially to some extent with respect to the shaft.

During operation, a shaft can rotatably drive the impeller 406 such that fluid may flow both axially and radially, which may be referred to as "mixed" flow. For example, fluid can enter the impeller 406 via throats at a lower end interior to the lower balance ring 418 and be driven by the rotating impeller 406 axially upwardly and radially outwardly to exit via throats proximate to the upper balance ring 408. In such an example, individual throats may be defined at least in part by adjacent impeller blades 409.

As an example, the balance holes 407 can provide for fluid communication between a throat space (e.g., space between adjacent vanes 409, a hub surface of the hub portion 412 and a shroud surface of the shroud portion 413) and an upper chamber that is at least in part radially interior to the upper balance ring 408. Such fluid communication can provide for balancing of pressure forces.

During operation, where a fluid may include particles, a portion of the particles may migrate radially exterior to the lower balance ring 418 and a portion of the particles may migrate radially interior to the upper balance ring 408. Such particles may act as abrasive material that is moved by a rotating impeller, for example, in clearances with respect to one or more neighboring diffusers. Depending on characteristics of operation, position with respect to gravity, flow, fluid properties, particle properties, etc., particles may collect and build-up in one or more regions, which may detrimentally impact operation, performance, longevity, etc.

As to abrasive action, a balance ring of an impeller may wear as particles enter a clearance defined by a surface of the balance ring and, for example, a surface of a diffuser. Where such wear increases the clearance, pressure balancing of the impeller with respect to one or more neighboring diffusers may be effected. For example, a stage may experience an increase in down thrust forces because of higher back pressure on a hub side (e.g., in a chamber interior to an upper balance ring).

As an example, an upper portion of an impeller may be referred to as a fluid outlet side, a hub side, a trailing side, etc., and, as an example, a lower portion of an impeller may be referred to as a fluid inlet side, a shroud side, a leading side, etc. For example, an individual blade (e.g., or vane) of an impeller can include a leading edge and a trailing edge where fluid enters at the leading edge and exits at the trailing edge. As an example, two adjacent blades can form an inlet throat disposed between their respective leading edges and an outlet throat disposed between their respective trailing edges.

As an example, an impeller can include multiple upper balance rings and/or multiple lower balance rings. In such an example, an impeller may include at least two upper balance rings that are at least in part concentric and/or may include at least two lower balance rings that are at least in part concentric. As an example, an impeller may include at least two upper balance rings that are at least in part concentric and/or may include at least one lower balance ring. As an example, an impeller may include at least one upper balance ring and/or may include at least two lower balance rings that are at least in part concentric.

As an example, an impeller can include a primary balance ring that can act as a sand guard to expel sand particles that may be driven in a direction toward a balance chamber. In such an example, the primary balance ring or sand guard can be an extension portion, for example, from an impeller hub portion and tip. Where a sand guard is integral to an impeller, the sand guard rotates at the same rotational speed (e.g., rpm) as the impeller and thus can diffuse sand particles away from a balance ring area. Where one balance ring is disposed at a radius that is larger than another balance ring, the balance ring with the larger radius will move at a greater tangential speed (e.g., centimeters per second) than the balance ring with the smaller radius. As an example, tangential speed of a surface of a balance ring can be directly proportional to the radius of the surface of the balance ring.

As an example, a balance ring that acts as a sand guard may include a surface that is disposed at a radius that is greater than a surface of another balance ring. In such an example, the tangential speed of the surface of the sand guard balance ring can exceed the tangential speed of the surface of the other balance ring. Such an increase in tangential speed may act to repel particles and guard against sand intrusion to a greater extent than an impeller without the balance ring that acts as a sand guard (e.g., an impeller with a single upper balance ring).

Referring again to the pump 400 of FIG. 4, an enlarged cross-section view of a portion of the pump 400 is shown that includes a housing 430 (e.g., a cylindrical tube-shaped housing), a first diffuser 440-1, a second diffuser 440-2 and an impeller 460 disposed at least in part axially between the first diffuser 440-1 and the second diffuser 440-2. In the enlarged cross-sectional view, various features of the impeller 460 are shown, including a lower end 461, an upper end 462, a hub 465 (e.g., a hub portion of the impeller 460), a shroud 466 (e.g., a shroud portion of the impeller 460), a balance hole 467, an upper balance ring 468, an upper guard ring 469, and a lower balance ring 495. As shown in FIG. 4, the hub 465 includes a through bore that defines an axis (e.g., z-axis). Various features of the diffusers 440-1 and 440-2 are also shown in FIG. 4, including diffuser vanes 480-1 and 480-2. As an example, various features of an impeller, a diffuser, an assembly, etc., may be described with respect to a cylindrical coordinate system (e.g., r, z and Θ).

In the enlarged cross-sectional view, arrows are shown that approximately represent a general direction of fluid flow through the diffuser 440-2, the impeller 460 and the diffuser 440-1. For example, fluid can enter via leading edges of the vanes 480-2 of the diffuser 440-2 and reach a chamber 450 at the trailing edges of the vanes 480-2. As shown, the chamber 450 provides for flow of fluid to the leading edges of the blades 490 of the impeller 460, which, during rotation, can drive the fluid to a chamber 455 at the trailing edges of the blades 490 of the impeller 460. As shown, the chamber 455 provides for flow of fluid to the leading edges of the vanes 480-1 of the diffuser 440-1. The arrows indicate that flow can be both axial and radial as it progresses through the pump 400.

The enlarged cross-sectional view also shows chambers 453 and 470, which may be amenable to particle collection (e.g., sand build-up, etc.). For example, particles may move radially inward from the chamber 453 to the chamber 450. In such an example, particles may migrate into and through a clearance between a surface of the lower balance ring 495 and a surface of the diffuser 440-2. As to the chamber 470, particles may move radially inwardly from the chamber 455 to the chamber 470. In such an example, particles may migrate into and through a clearance between a surface of the upper guard ring 469 and a surface of the diffuser 440-1 and may migrate further into and through a clearance between a surface of the upper balance ring 468 and a surface of the diffuser 440-1.

As shown in the enlarged cross-sectional view of FIG. 4, the clearance formed by the upper guard ring 469 and the diffuser 440-1 may act to diminish migration of particles to the chamber 470. For example, without the upper guard ring 469, particles that reach the chamber 470 would have migrated via a single clearance from the chamber 455 to the chamber 470; whereas, with the upper guard ring 469, particles that reach the chamber 470 would have migrate via two clearances from the chamber 455 to the chamber 470. As such, the upper guard ring 469 may be referred to as a particle guard or, for example, a sand guard, as it acts as a barrier that hinders flow of particles from the chamber 455 to the chamber 470.

As an example, a guard ring may be machined into an impeller, cast as an integral feature of an impeller, cast and machined as an integral feature of an impeller, etc.

As an example, a guard ring can extend from an impeller hub and tip. In such an example, when fluid discharges from an impeller exit, the guard ring can act as barrier to helps to prevent particles from migrating toward a balance ring (e.g., by convection, diffusion, etc.). As an example, a guard ring may rotate where such rotation provides centrifugal force on surrounding fluids. As an example, one or more surfaces of a guard ring can be rough (e.g., roughened, etc.) to include, for example, grooves or patterns that may provide for increased turbulence, which may cause particles to remain within a flow path (e.g., to throats of a diffuser, etc.).

As an example, multiple upper rings can act to maintain and control leakage flow pass an interior-most ring and into a balancing chamber while, for example, reducing wear of at least the interior-most ring. Such an effect may be achieved via the presence of an exterior ring hindering passage of particles and thereby reducing the number, amount, etc., of particles that reach the interior-most ring. As such an approach can reduce wear of a ring, pressure balancing performed by a pressure balancing chamber (see, e.g., the chamber 470) may be preserved (or deteriorated to a lesser degree). In such an example, the pressure balancing chamber may more effectively maintain its balancing function, which can, in turn, reduce down thrust (e.g., where conditions exist that may prompt down thrust). In such an example, reliability and run life of at least a pump of an ESP may be enhanced.

Figure 5:
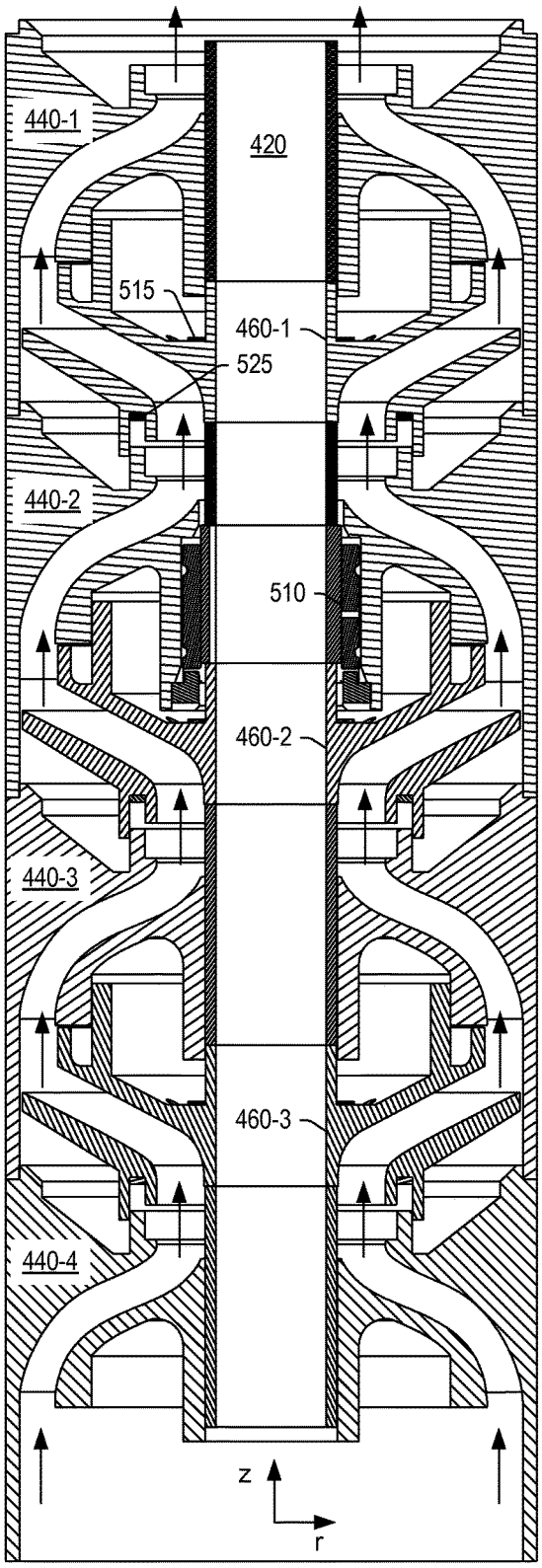
FIG. 5 illustrates an example of a portion of a pump.

FIG. 5 shows an example of a portion of the pump 400 as including diffusers 440-1, 440-2, 440-3 and 440-4 and as including impellers 460-1, 460-2 and 460-3. As shown in FIG. 5, the pump 400 can include one or more bearing assemblies 510, one or more thrust washers 515 and one or more thrust washers 525. As to the diffuser 440-2, it is shown as including features to accommodate the bearing assembly 510. For example, the bearing assembly 510 may be accommodated (e.g., located, etc.) as least in part via a portion of the diffuser 440-2. In such an example, the bearing assembly 510 can rotatably support a shaft, which may be a multi-piece, stacked shaft that may include segments 420 stacked with respect to hub portions of impellers. As an example, a key or keys may optionally be utilized, for example, in conjunction with a keyway or keyways to couple rotating components of a pump.

Figure 6:
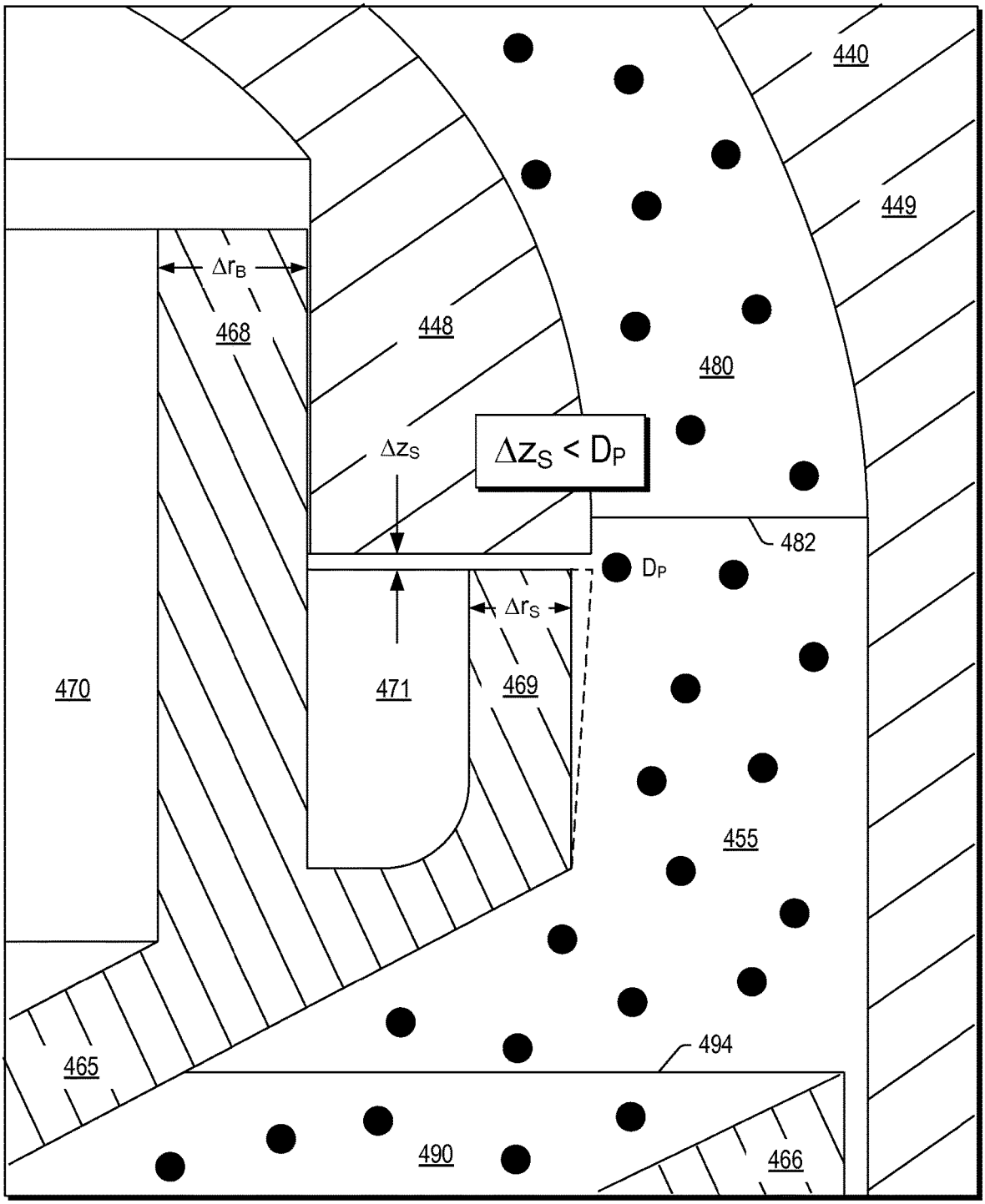
FIG. 6 illustrates an example of a portion of a pump.

FIG. 6 shows an enlarged cross-sectional view of a portion of the pump 400 as including a diffuser 440 and an impeller 460, which define chambers 455, 470 and 471. In the example of FIG. 6, the chambers 455, 470 and 471 span a common axial distance. For example, a line may be drawn radially across that intersects the chambers 455, 470 and 471. However, in the example of FIG. 6, flow of fluid (e.g., and particles) is prohibited in such a direct radial manner.

In the example of FIG. 6, a clearance may be defined as $\Delta z_S$, which is between a surface of a portion 448 of the diffuser 440 and a surface of the upper guard ring 469. Such surfaces may be, for example, substantially annular, axially facing surfaces. Radially, the clearance spans a distance $\Delta r_S$ of a portion of the upper guard ring 469 where the chamber 471 includes an upper opening that is disposed radially interiorly to the portion of the upper guard ring 469. As an example, at least a portion of particles in the chamber 455 may be of a particle size $D_P$ that exceeds the size of the clearance $\Delta z_S$. In such an example, such particles may be prohibited from entering the clearance formed in part by the upper guard ring 469 (e.g., a sand guard ring).

As an example, during operation, the axial position of the impeller 460 may shift with respect to the axial position of the diffuser 440. In such an example, the clearance $\Delta z_S$ may also change. As the size of the clearance changes, a greater or a lesser risk may exist for particles to enter the chamber 471. Depending on pressures and other forces, as well as characteristics of particles, particles may move radially inwardly or radially outwardly. For example, consider an operational mode that may reverse direction of rotation of a motor that drives a shaft to which impellers are operatively coupled. In such an example, where a clearance increases, forces may exist during "reverse" operation that cause particles to move radially outwardly, for example, to exit the chamber 471 via a clearance. As an example, a controller may include an anti-sanding mode of operation that may utilize features of an impeller such as the impeller 460 of FIG. 6.

As an example, a drive may slow down rotational speed of a motor and then reverse the rotational direction of the motor and increase the rotational speed to a target speed, which may be, for example, an anti-sanding (e.g., de-sanding) speed. Such a speed may be based at least in part on sand conditions, indicated power losses (e.g., due to sanding), etc. After a period of time in reverse, the drive may ramp down the reverse rotation and re-commence operation in a rotational direction that causes fluid to be propelled in an intended direction (e.g., uphole, etc.).

As to the upper balance ring 468, it is illustrated in the example of FIG. 6 as including a radial thickness $\Delta r_B$ and as having an axial dimension that is greater than that of the upper guard ring 469 such that a clearance is formed between a radially, outwardly facing surface of the upper balance ring 468 and a radially, inwardly facing surface of the portion 448 of the diffuser 440. Such a clearance may be sized to allow for axial movement of the impeller 460 with respect to the diffuser 440 while retaining a pressure balancing function of the chamber 470. As mentioned, where the radially, outwardly facing surface of the upper balance ring 468 and/or the radially, inwardly facing surface of the portion 448 of the diffuser 480 wear (e.g., due to sand abrasion), fluid may flow more readily within the enlarged clearance, which, in turn, may diminish the pressure balancing function of the chamber 470. Again, a sand guard (e.g., an upper guard ring) may help to preserve such pressure balancing function where fluid includes particles (e.g., sand particles, etc.).

In the example of FIG. 6, a dashed line is shown as extending from a corner of the upper guard ring 469. The dashed line indicates that a surface of the upper guard ring 469 may be set at an angle, for example, other than 90 degrees. As mentioned, such a surface may include one or more features (e.g., roughness, etc.), which may act to increase fluid turbulence at or near a mouth of a clearance.

As an example, particles may be characterized at least in part via one or more parameters for clastic sediments. For example, consider one or more of a scale parameter, size range parameters, Wentworth range parameters, a name parameter, etc. As an example, a pump may include at least one impeller and at least one diffuser for particles with one or more of a clastic sediment scale range of about 3 to about 1, a size range from about 125 microns to about 0.5 millimeters, a Wentworth range from about 0.0049 inches to about 0.02 inches, and a name of fine sand to a name of medium sand.

Figure 7:
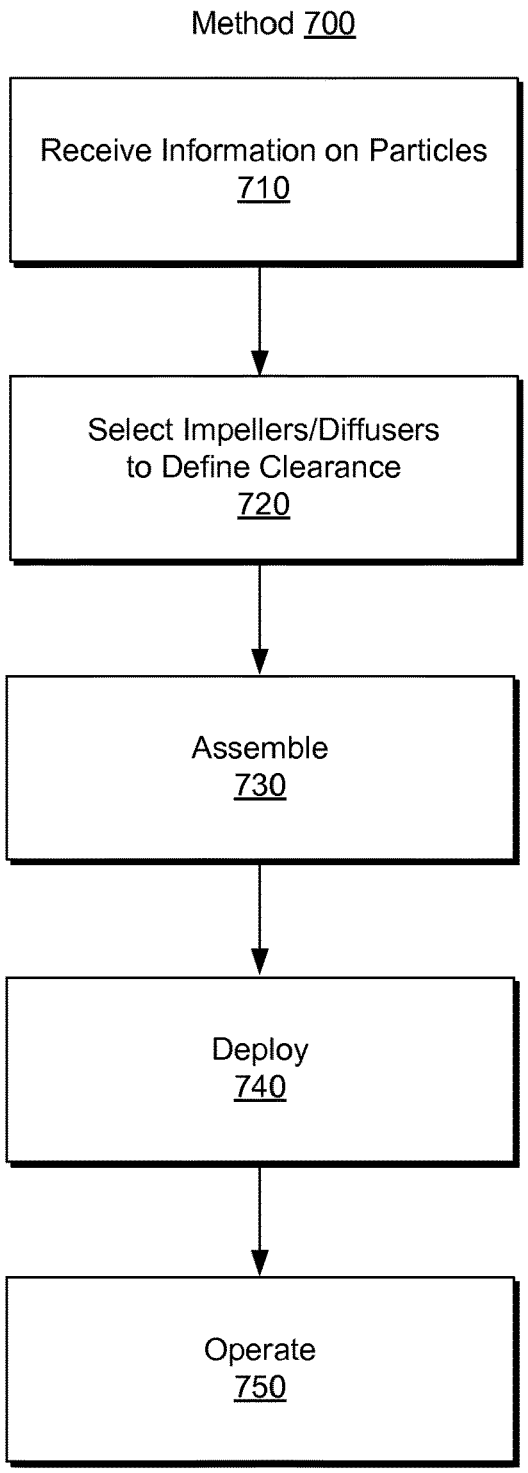
FIG. 7 illustrates an example of a method.

FIG. 7 shows an example of a method 700 that includes a reception block 710 for receiving information about particles, a selection block 720 for selecting impellers and/or diffusers to form a desired clearance based at least in part on the information about the particles, an assembly block 730 for assembling a pump that includes the selected impellers and/or diffusers, a deployment block 740 for deploying the assembled pump in a downhole environment and an operation block 750 for operating the pump in the downhole environment.

As an example, information about particles may include particle size information, particle material information, particle density information, particle population density information in fluid, etc. As an example, selection of impellers and/or diffusers may include predicting functioning of pressure balancing chambers of a pump given information about particles. For example, selection of impellers and/or diffusers may be based at least in part on how much one or more guard features may extend functioning of pressure balancing chambers for a particular application (e.g., lifetime, service schedule, volume of fluid pumped, etc.).

As an example, a mixed-flow impeller for an electric submersible pump can include a lower end and an upper end; a hub that includes a through bore that defines an axis; blades that extend at least in part radially outward from the hub where each of the blades includes a leading edge and a trailing edge; an upper balance ring that includes a radially inward facing balance chamber surface and a radially outward facing diffuser clearance surface; and an upper guard ring disposed radially outwardly from the upper balance ring where the upper guard ring includes an axially facing diffuser clearance surface that is disposed axially between the trailing edges of the blades and the upper end.

As an example, an upper balance ring may define an upper end of a mixed-flow impeller. As an example, an upper balance ring may be an extension from a hub. As an example, a hub may define an upper end of a mixed-flow impeller.

As an example, an upper guard ring can include a radially inward facing chamber surface that defines at least a portion of a chamber intermediate an upper balance ring and an upper guard ring, for example, consider the chamber 471 shown in FIG. 6 as defined in part between the upper balance ring 468 and the guard ring 469. In the example of FIG. 6, access to the chamber 471, from the chamber 455, is via the clearance between the portion of the diffuser 448 and the upper guard ring 469.

As an example, an upper balance ring can have an axial span that exceeds an axial span of an upper guard ring, for example, consider the upper balance ring 468 and the upper guard ring 469 of FIG. 6.

As an example, in a mixed-flow impeller, a hub can include at least one balance passage that is located axially between leading edges and trailing edges of blades of the impeller.

As an example, a mixed-flow impeller may include a lower balance ring and, for example, a lower guard ring.

Figure 8:
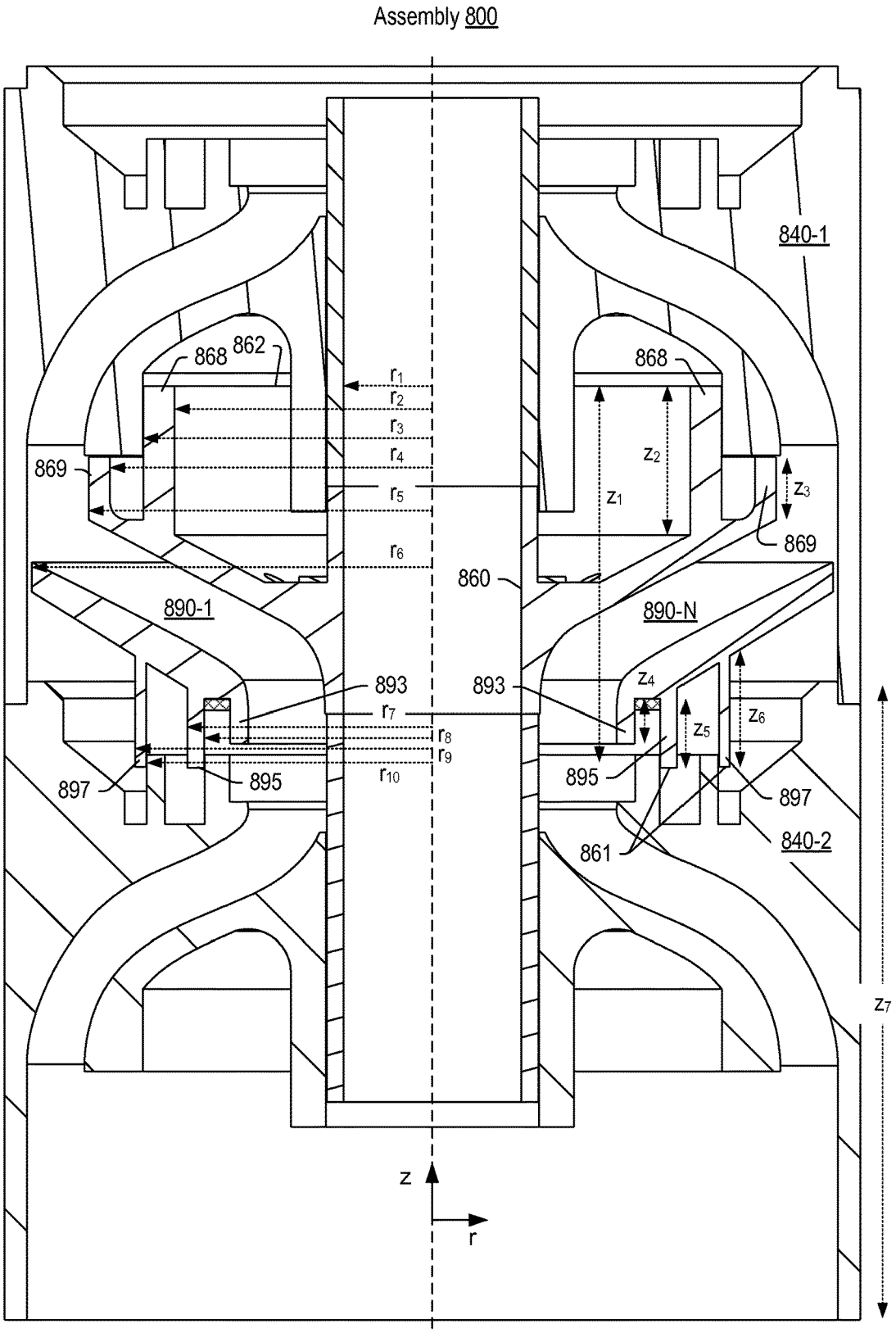
FIG. 8 illustrates an example of a portion of a pump.

FIG. 8 shows an example of an assembly 800 that includes a first diffuser 840-1, a second diffuser 840-2 and an impeller 860. In the example of FIG. 8, the impeller 860 includes a lower end 861, an upper end 862, a hub 865 (e.g., a hub portion of the impeller 860), a shroud 866 (e.g., a shroud portion of the impeller 860), an upper balance ring 868, an upper guard ring 869, a lower shroud ring 893, a lower balance ring 895 and a lower guard ring 897; noting that, for example, one or more of the lower features may define the lower end 861; whereas, for example, the upper balance ring 868 may define the upper end 862 (e.g., depending on hub length, etc.).

In FIG. 8, various dimensions are shown, including radial dimensions and axial dimensions. For example, the impeller 860 can include a bore radius $r_1$, an upper balance ring inner radius $r_2$, an upper balance ring outer radius $r_3$, an upper guard ring inner radius $r_4$, an upper guard ring outer radius $r_5$, a maximum outer diameter $r_6$ (e.g., radially outboard a trailing edge of an impeller blade 890-1 or 890-N, etc.), a lower balance ring outer radius $r_7$, a lower balance ring inner radius $r_8$, a lower guard ring outer radius $r_9$ and a lower guard ring inner radius $r_{10}$.

As an example, the lower shroud ring 893 may be defined by an inner radius and an outer radius, which may determine a radial thickness of the lower shroud ring 893. In the example of FIG. 8, the lower shroud ring 893 extends to a shroud wall of the shroud 866 of the impeller 860. The blades 890-1 to 890-N of the impeller 860 may be defined by respective leading edges and trailing edges as well as junctures with a hub portion of the impeller 860 and junctures with the shroud wall of the impeller 860. As shown in FIG. 8, the blades 890-1 and 890-N extend axially and radially, for example, to direct fluid axially upwardly and radially outwardly (e.g., mixed-flow).

Also shown in FIG. 8 are axial dimensions, including an impeller axial height $z_1$, an upper balance ring chamber-side axial height $z_2$, an upper guard ring outer side axial height $z_3$, a lower clearance height $z_4$ (e.g., in a thrust washer space), a lower balance ring axial height $z_5$ and a lower guard ring axial height $z_6$.

As to the diffusers 840-1 and 840-2, various features may be defined via radial, axial and/or azimuthal dimensions. FIG. 8 shows an axial height $z_7$ of the diffuser 840-2, which seats the diffuser 840-1 (e.g., to form a diffuser stack). As an example, two stacked diffusers may define an impeller space within which an impeller may be disposed and rotatably operated. During operation, the impeller may translate axially where axial translation forces may be "balanced" via one or more fluid chambers (e.g., pressure balance chambers), which may be defined in part by one or more impeller surfaces and in part by one or more diffuser surfaces.

As shown in the example assembly 800 of FIG. 8, the upper guard ring 869 and the lower guard ring 897 of the impeller 860 have maximum radii (e.g., maximum diameters) that are less than the maximum radius (e.g., maximum diameter) of the impeller 860. As shown, the lower guard ring 897 is disposed radially outwardly from a fluid inlet to a blade region of the impeller 860 and the upper guard ring 869 is disposed radially adjacent to a fluid output to a blade region of the impeller 860. For example, moving radially outward at an upper axial position of the impeller 860, the assembly 800 includes the upper balance ring 868, the upper guard ring 869 and a fluid outlet that directs fluid to a fluid inlet of the diffuser 840-1; while, moving radially outward at a lower axial position of the impeller 860, the assembly includes a fluid inlet to the blades 890-1 to 890-N of the impeller 860, a thrust washer space, the lower balance ring 895 and then the lower guard ring 897.

As an example, an assembly can include dimensions of diffusers and impellers that provide for hindering migration of particles and that provide for balancing various forces such as, for example, axial thrust forces (e.g., via one or more balance chambers, etc.). As an example, an axial dimension (e.g., axial length) of a guard ring (e.g., lower and/or upper) may be selected to provide a desired amount of hindrance of particle migration, which may guard against erosion of one or more surfaces by particles (e.g., sand, etc.).

As an example, radial distance of lower and/or upper guard rings from a center axis of a shaft may be selected as parameters that may be adjusted to make an impeller that can provide a desired amount of pressure balancing, for example, to balance axial down thrust forces. As an example, a length ratio of two rings may be selected as parameters that may be adjusted to make an impeller that can provide a desired amount of effectiveness to hinder particle migration (e.g., as sand guard rings that operate to diminish sand erosion/wear). As an example, a method can include receiving information about particles in fluid to be pumped and making (e.g., or selecting) an impeller designed to provide acceptable performance in the presence of such particles for a desired duration, flow rate, etc. of pumping.

Figure 9:
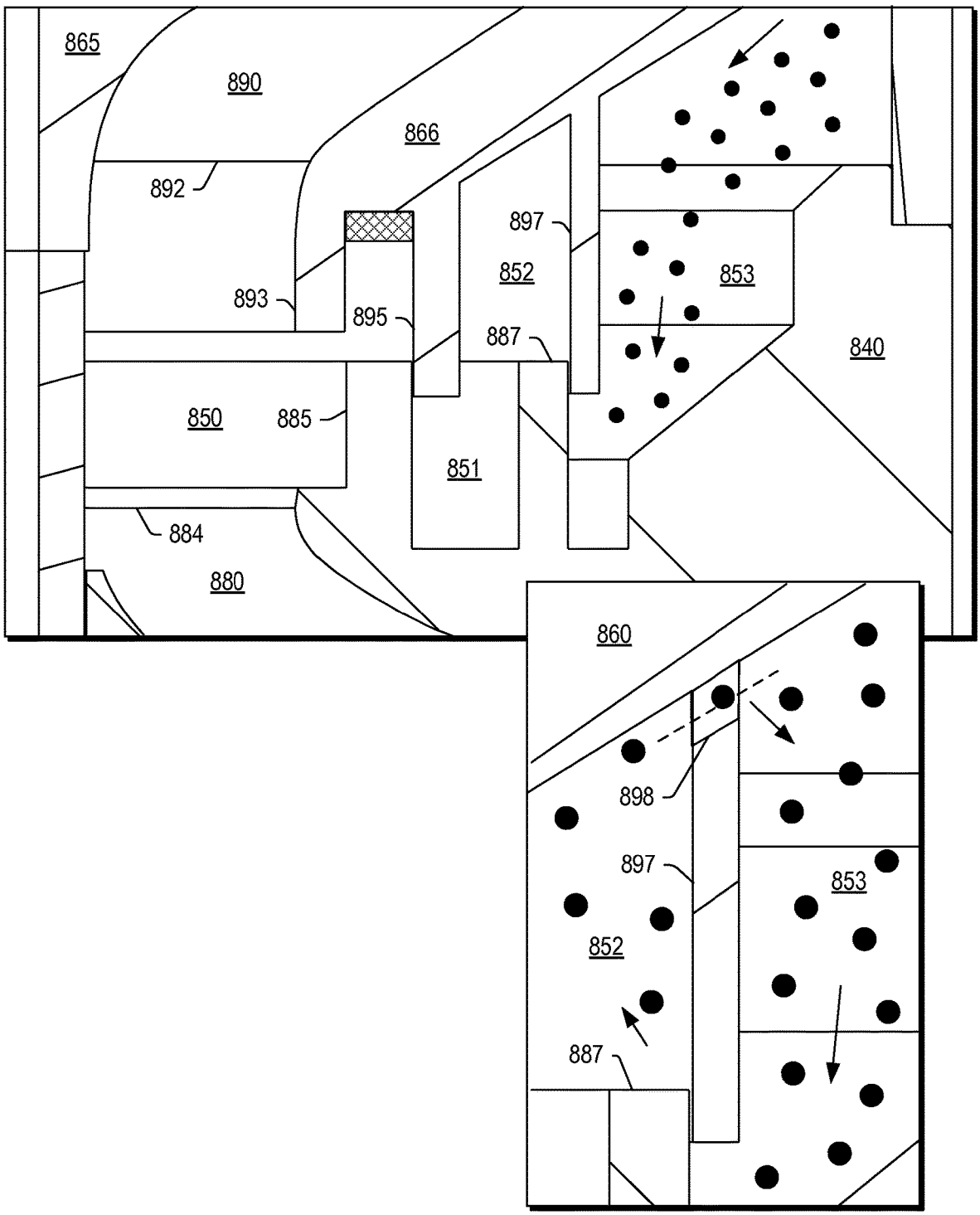
FIG. 9 illustrates an example of a portion of a pump.

FIG. 9 shows an enlarged cross-sectional view of a portion of the assembly 800 of FIG. 8. As shown, the impeller 860 includes the lower shroud ring 893, the lower balance ring 895 and the lower guard ring 897 where the lower guard ring 897 is disposed radially outwardly from the lower balance ring 895 and where a chamber 852 is disposed between the lower balance ring 895 and the lower guard ring 897. Also shown in the example of FIG. 9 is one of the impeller blades (e.g., impeller blade 890) that includes a leading edge 892, which is disposed an axial distance from an axial end of the lower shroud ring 893.

In the example of FIG. 9, the diffuser 840 includes a diffuser vane 880 with a trailing edge 884, an inner ring 885 and an outer ring 887 where a chamber 851 is disposed between the inner ring 885 and the outer ring 887.

As shown in the example of FIG. 9, various chambers 850, 851, 852 and 853 exist, which are disposed axially between the impeller 860 and the diffuser 840. These may be referred to as, for example, lower chambers as they are located axially proximate to where flow is coupled between an outlet of the diffuser 840 and an inlet of the impeller 860.

Such lower chambers may be defined by upper surfaces of the diffuser 840 and/or lower surfaces of the impeller 860; noting that the chamber 853 may be defined in part via another diffuser (e.g., a diffuser that is axially stacked on the diffuser 840).

As an example, vanes of a diffuser may define diffuser throats that are stationary (e.g., not rotating) and blades of an impeller may define impeller throats that rotate when the impeller rotates. In such an example, surfaces of the impeller may be rotating surfaces that define clearances with respect to stationary surfaces of the diffuser (e.g., or diffusers). As an example, some amount of axial movement may occur during operation, thus, some clearance surfaces may rotate and/or translate with respect to each other (e.g., depending on operational conditions, etc.).

Referring again to the example of FIG. 6, the chambers 455, 470 and 471 may be referred to as, for example, upper chambers as they are located axially proximate to where flow is coupled between an outlet of the impeller 460 and an inlet of the diffuser 440. Such upper chambers may be defined by upper surfaces of the impeller 460 and/or by lower surfaces of the diffuser 440.

In the example of FIG. 9, the presence of the lower guard ring 897 in combination with the outer ring 887 of the diffuser 840, presents an obstacle to migration of particles, for example, from the chamber 853 to the chamber 852 and onward to the chamber 851 and, for example, to the chamber 850. As an example, the chambers 851 and 852 may, depending on operational conditions, act in part to balance pressure. For example, consider a downward force being exerted on the impeller 860 with respect to the diffuser 840. In such an example, fluid in the chambers 851 and 852 may resist compression and thereby counteract at least a portion of the downward force.

Approximate examples of particles are also shown in FIG. 9 for purposes of illustrating migration in a direction axially downward and radially inward, for example, toward the lower guard ring 897. As an example, the lower guard ring 897 can include one or more passages 898 (e.g., one or more bleed holes), which may provide for circulation of particles (e.g., sand, etc.). For example, the passage 898 is illustrated as being located between an end of the lower guard ring 897 and the shroud wall of the shroud 866 of the impeller 860 (e.g., optionally adjacent to the shroud wall). In such an example, particles in the chamber 852 may move in a direction toward the shroud wall and out of the chamber 852 via the passage 898, which can, for example, help to guard the lower balance ring 895 from such particles.

Figure 10:
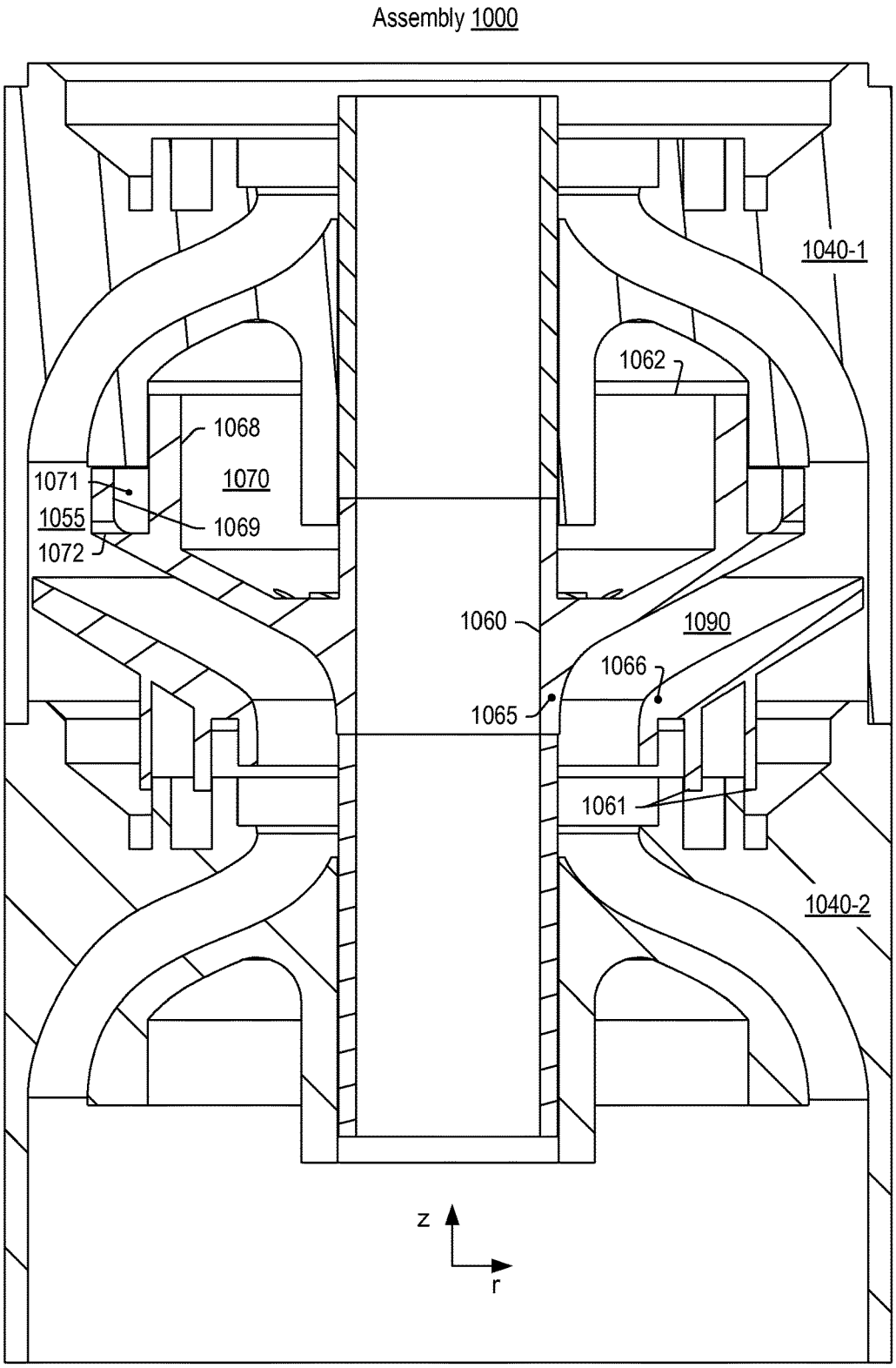
FIG. 10 illustrates an example of a portion of a pump.

FIG. 10 shows an example of an assembly 1000 that includes a first diffuser 1040-1, a second diffuser 1040-2 and an impeller 1060. In the example of FIG. 10, the impeller 1060 includes a lower end 1061, an upper end 1062, a hub 1065 (e.g., a hub portion of the impeller 1060), a shroud 1066 (e.g., a shroud portion of the impeller 1060), an upper balance ring 1068, an upper guard ring 1069 and a passage or passages 1072 that provide for fluid communication between a chamber 1071 and a chamber 1055; noting that FIG. 10 also shows a blade 1090 disposed at least in part between the hub 1065 and the shroud 1066. In such an example, particles that may migrate to the chamber 1071 may be expelled therefrom via the one or more passages 1072. As an example, where a passage such as the passage 1072 includes a radial path, force generated via rotation of the impeller 1060 may facilitate expulsion of particles via the passage 1072.

As an example, a passage may include a path that is disposed substantially orthogonal to a guard ring such that a radial line may be traced from an axis of rotation of an impeller through the passage. In such an example, forces may promote expulsion of particles via the passage. As an example, a passage may be disposed at an angle. Such an angle may, for example, act to direct particles toward fluid flowing past an opening of the passage. For example, a passage may include an axial tilt to direct particles against a direction of oncoming fluid or with a direction of oncoming fluid. As an example, where particles are directed with a direction of oncoming fluid, venturi type of flow may act to promote expulsion of particles via the passage.

As an example, a passage of may be referred to as a bleed hole, a port, etc. For example, the passage 1072 may be a bleed hole passage that can bleed fluid and/or particles from the chamber 1071 to the chamber 1055.

Figure 11:
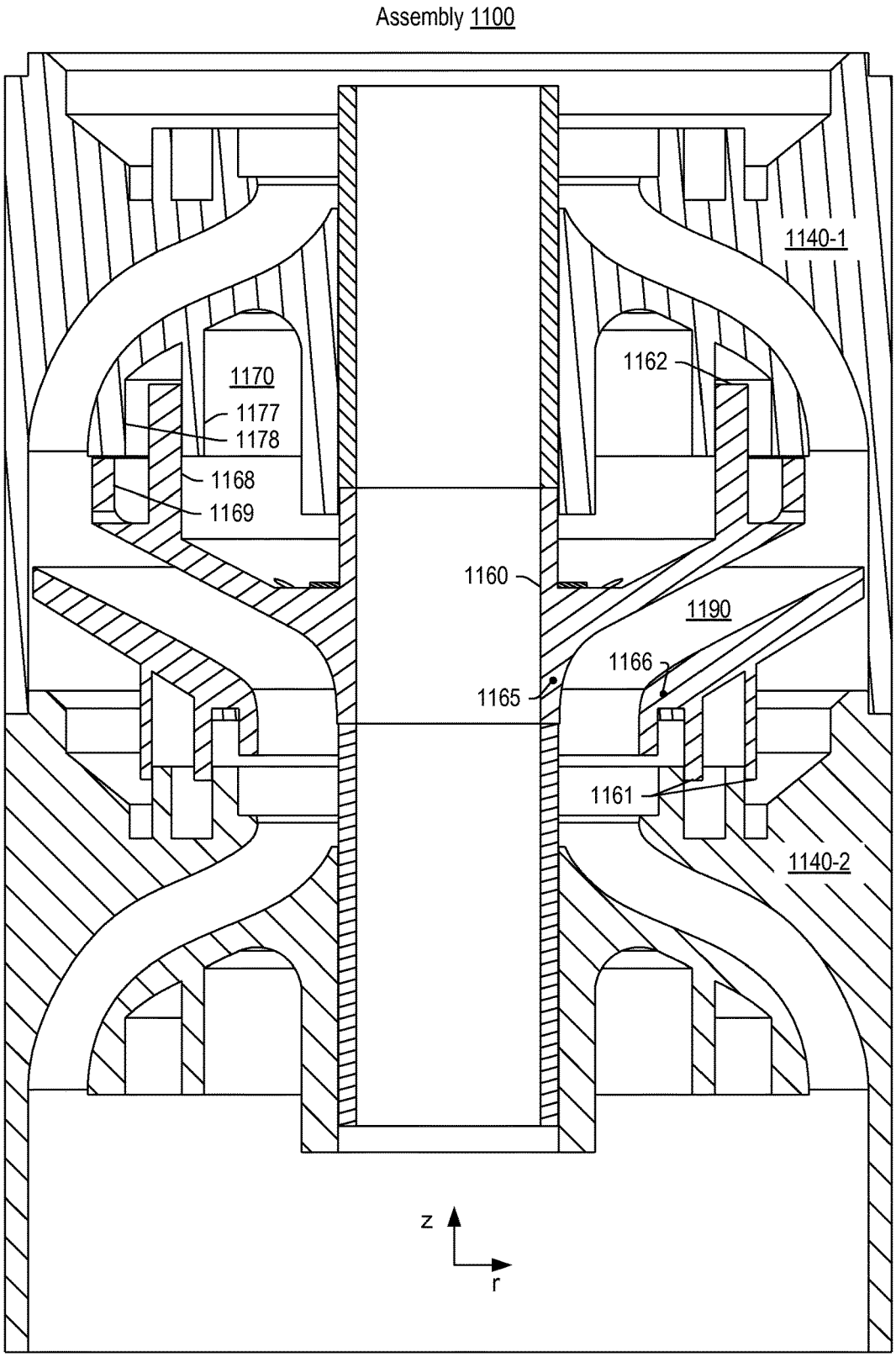
FIG. 11 illustrates an example of a portion of a pump.

FIG. 11 shows an example of an assembly 1100 that includes a first diffuser 1140-1, a second diffuser 1140-2 and an impeller 1160. In the example of FIG. 11, the diffuser 1140-1 includes an upper inner ring 1177 and an upper outer ring 1178 and the impeller 1160 includes a lower end 1161, an upper end 1162, a hub 1165 (e.g., a hub portion of the impeller 1160), a shroud 1166 (e.g., a shroud portion of the impeller 1160), an upper balance ring 1168 and an upper guard ring 1169. As shown, the upper balance ring 1168 can form a clearance with respect to a surface of the inner ring 1177. For particles to migrate to the chamber 1170, they would have to pass a clearance between the upper guard ring 1169 and the outer ring 1178 and then pass a clearance between the upper balance ring 1168 and the inner ring 1177. In so doing, the particles would need to rise axially to the level of the upper end of the upper balance ring 1168, which, during operation, is rotating. Such rotational force may act to drive particles radially outwardly, for example, to a passage in a guard ring (see, e.g., the passage 1072 of the impeller 1060 of FIG. 10).

Figure 12:
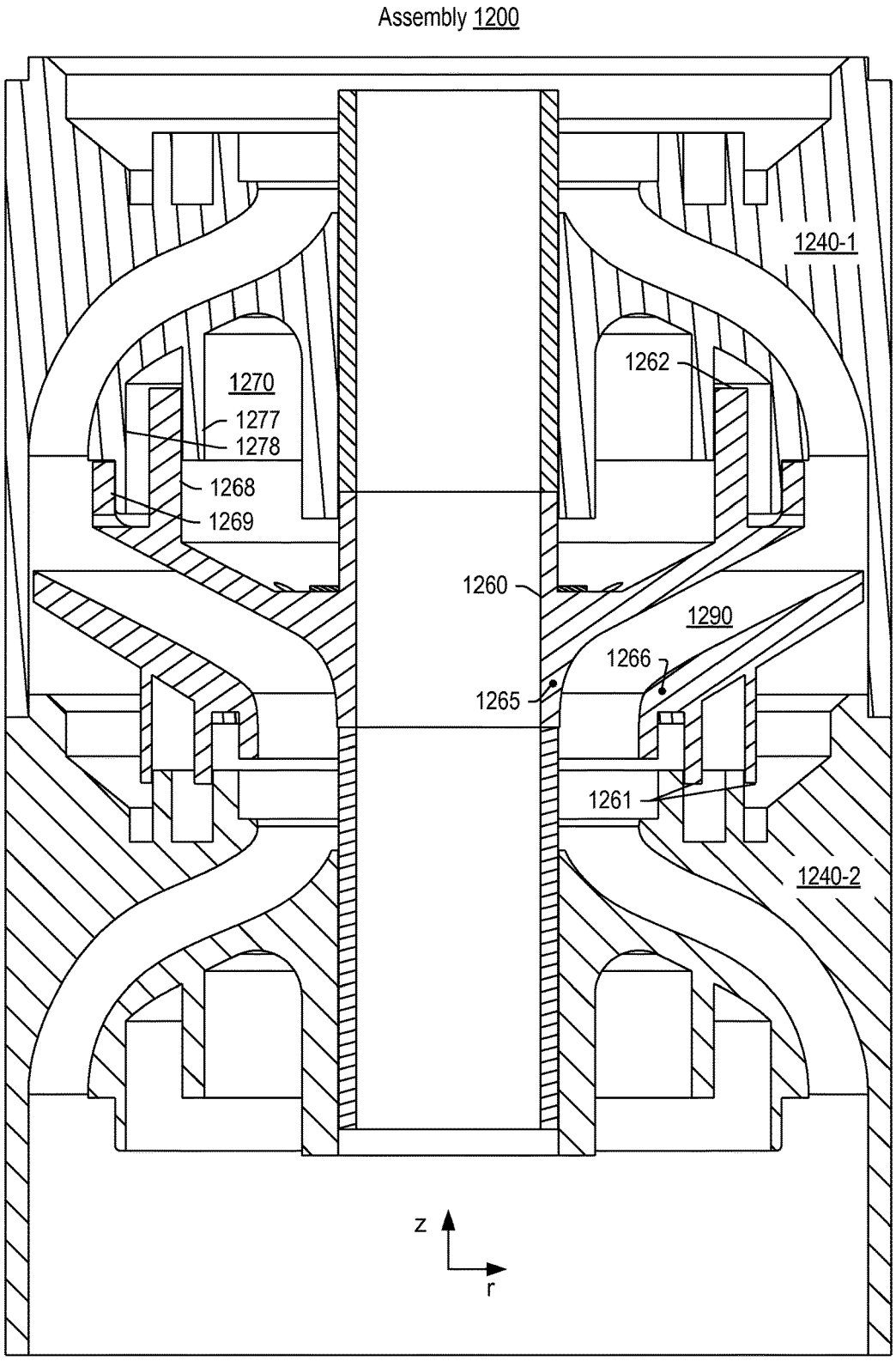
FIG. 12 illustrates an example of a portion of a pump.

FIG. 12 shows an example of an assembly 1200 that includes a first diffuser 1240-1, a second diffuser 1240-2 and an impeller 1260. In the example of FIG. 12, the diffuser 1240-1 includes an upper inner ring 1277 and an upper outer ring 1278 and the impeller 1260 includes a lower end 1261, an upper end 1262, a hub 1265 (e.g., a hub portion of the impeller 1260), a shroud 1266 (e.g., a shroud portion of the impeller 1260), an upper balance ring 1268 and an upper guard ring 1269; noting that FIG. 12 also shows a blade 1290 disposed at least in part between the hub 1265 and the shroud 1266. As shown, the upper balance ring 1268 can form a clearance with respect to a surface of the inner ring 1277 and the upper guard ring 1269 can form clearances with respect to surfaces of the outer ring 1278, which is shown as including an annular notch.

For particles to migrate to the chamber 1270, they would have to pass clearances between the upper guard ring 1269 and the outer ring 1278 (e.g., as defined by the notch) and then pass a clearance between the upper balance ring 1268 and the inner ring 1277. In so doing, the particles would need to rise axially to the level of the upper end of the upper balance ring 1268, which, during operation, is rotating. Such rotational force may act to drive particles radially outwardly, for example, to a passage in a guard ring (see, e.g., the passage 1072 of the impeller 1060 of FIG. 10).

Figure 13:
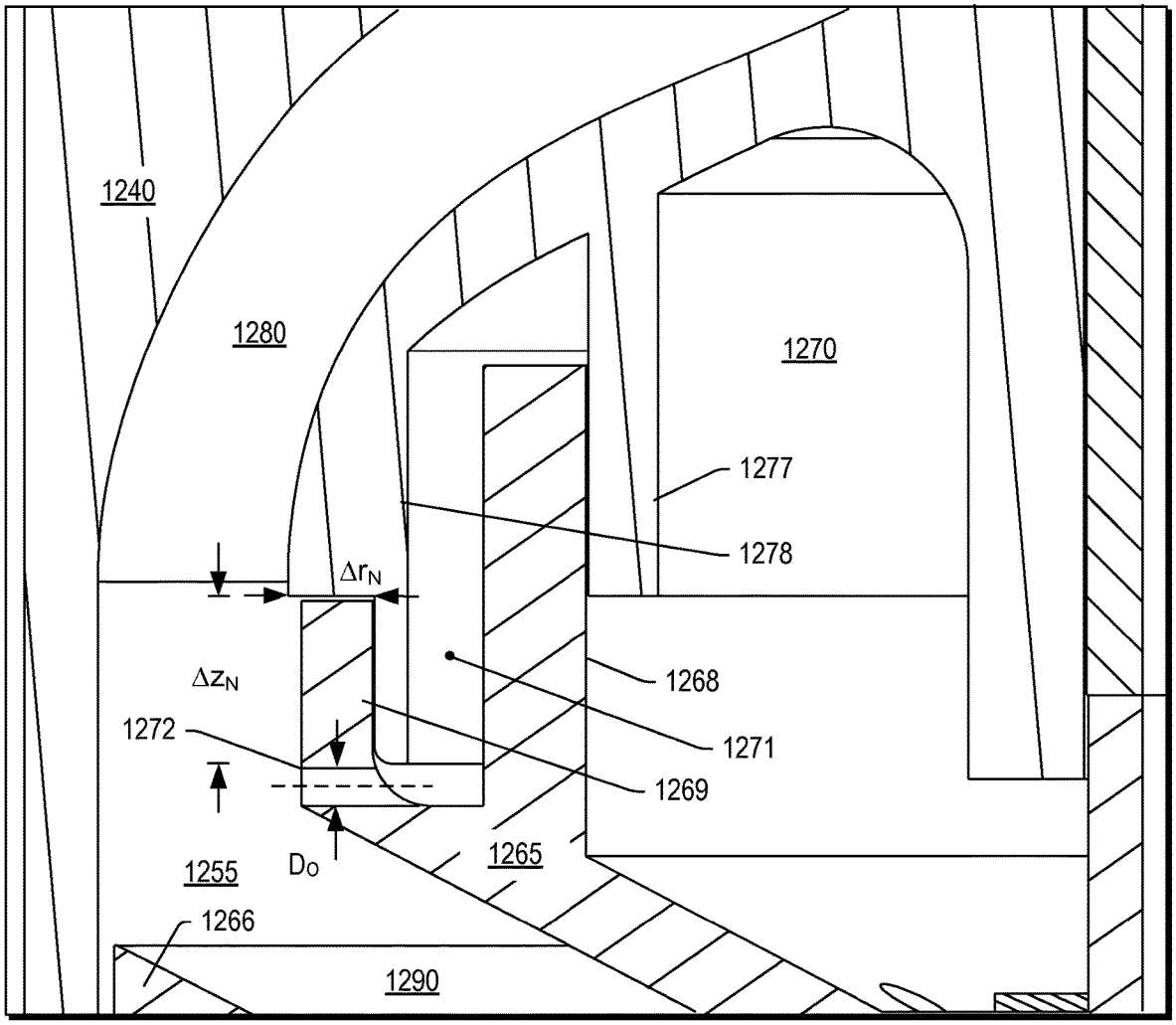
FIG. 13 illustrates an example of a portion of a pump.

FIG. 13 shows an enlarged cross-sectional view of a portion of the diffuser 1240 and the impeller 1260 of the assembly 1200 of FIG. 12 along with a chamber 1255 that is disposed between a leading edge of a diffuser vane 1280 and a trailing edge of an impeller blade 1290. In FIG. 13, chambers 1255, 1271 and 1270 are shown where various feature can hinder migration of particles from the chamber 1255 to the chamber 1271 and to the chamber 1270.

FIG. 13 also shows various dimensions including, for example, an axial notch dimension $\Delta z_N$ and a radial notch dimension $\Delta r_N$ as well as a dimension $D_O$ of a passage 1272 in the upper guard ring 1269. The notch dimensions may be selected to form clearance lengths, etc., with respect to the upper guard ring 1269.

The passage 1272 may allow for particles in the chamber 1271 to flow to the chamber 1255. For example, during operation, rotation of the impeller 1260 may cause force to be exerted on particles that may have migrated into the chamber 1271, these particles may move toward the passage 1272 and through the passage 1272 to exit in the chamber 1255 where they may, for example, encounter fluid flowing toward the leading edge of the diffuser vane 1280 of the diffuser 1240.

Figure 14:
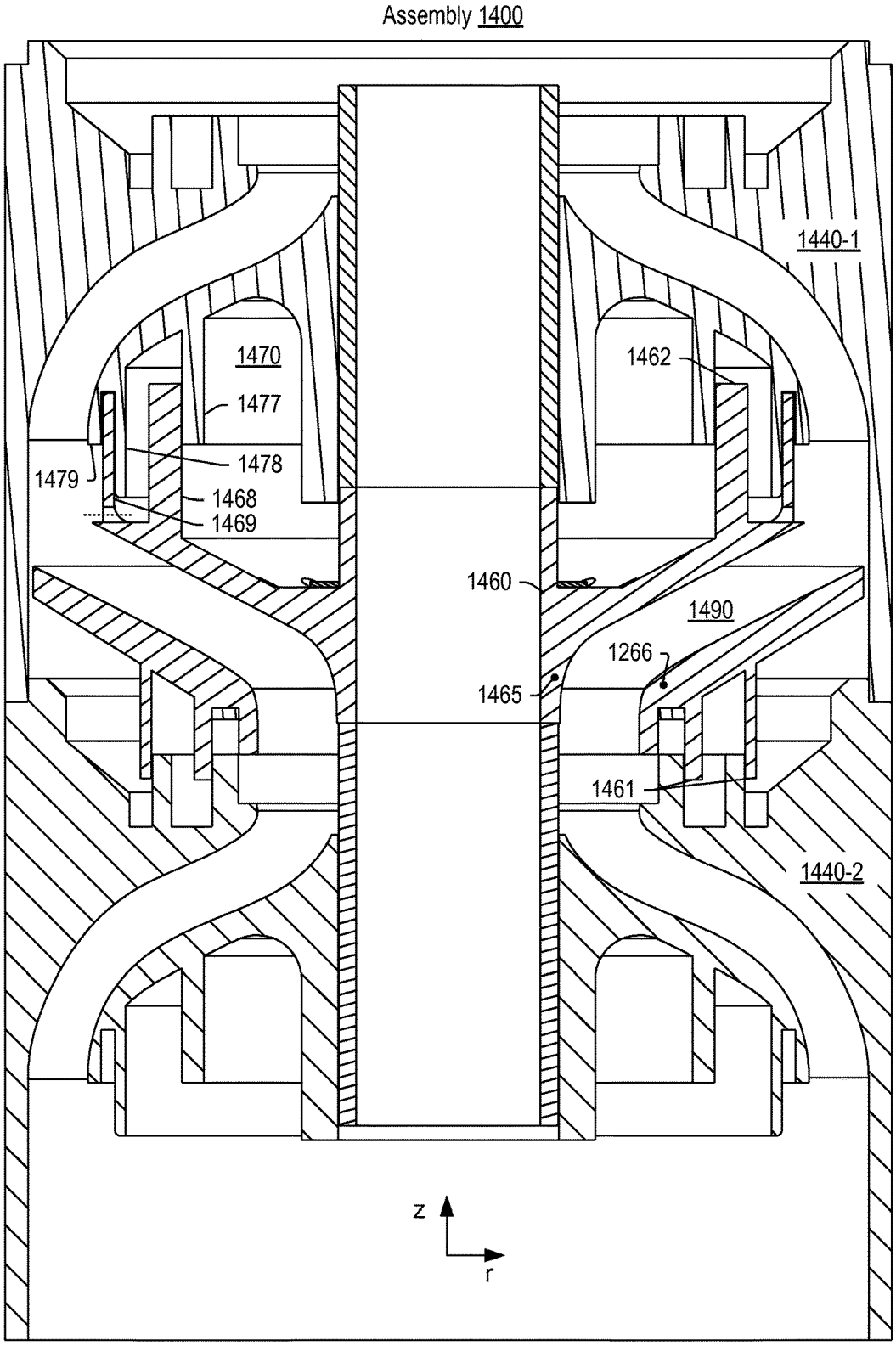
FIG. 14 illustrates an example of a portion of a pump.

FIG. 14 shows an example of an assembly 1400 that includes a first diffuser 1440-1, a second diffuser 1440-2 and an impeller 1460. In the example of FIG. 14, the diffuser 1440-1 includes an upper inner ring 1477, an upper intermediate ring 1478 and an upper outer ring 1479 and the impeller 1460 includes a lower end 1461, an upper end 1462, a hub 1465 (e.g., a hub portion of the impeller 1460), a shroud 1466 (e.g., a shroud portion of the impeller 1460), an upper balance ring 1468 and an upper guard ring 1469; noting that FIG. 14 also shows a blade 1490 disposed at least in part between the hub 1465 and the shroud 1466. As shown, the upper balance ring 1468 can form a clearance with respect to a surface of the inner ring 1477 and the upper guard ring 1469 can form clearances with respect to a surface of the intermediate ring 1478 and a surface of the outer ring 1469. For example, an annular notch may exist between the intermediate ring 1478 and the outer ring 1479 in which at least a portion of the upper guard ring 1469 may be positioned and, for example, axially translate during various operational conditions. In such an example, additional clearances are introduced compared to the assembly 1200 of FIG. 12, which may, for example, hinder flow of particles radially inwardly to a chamber 1470.

Figure 15:
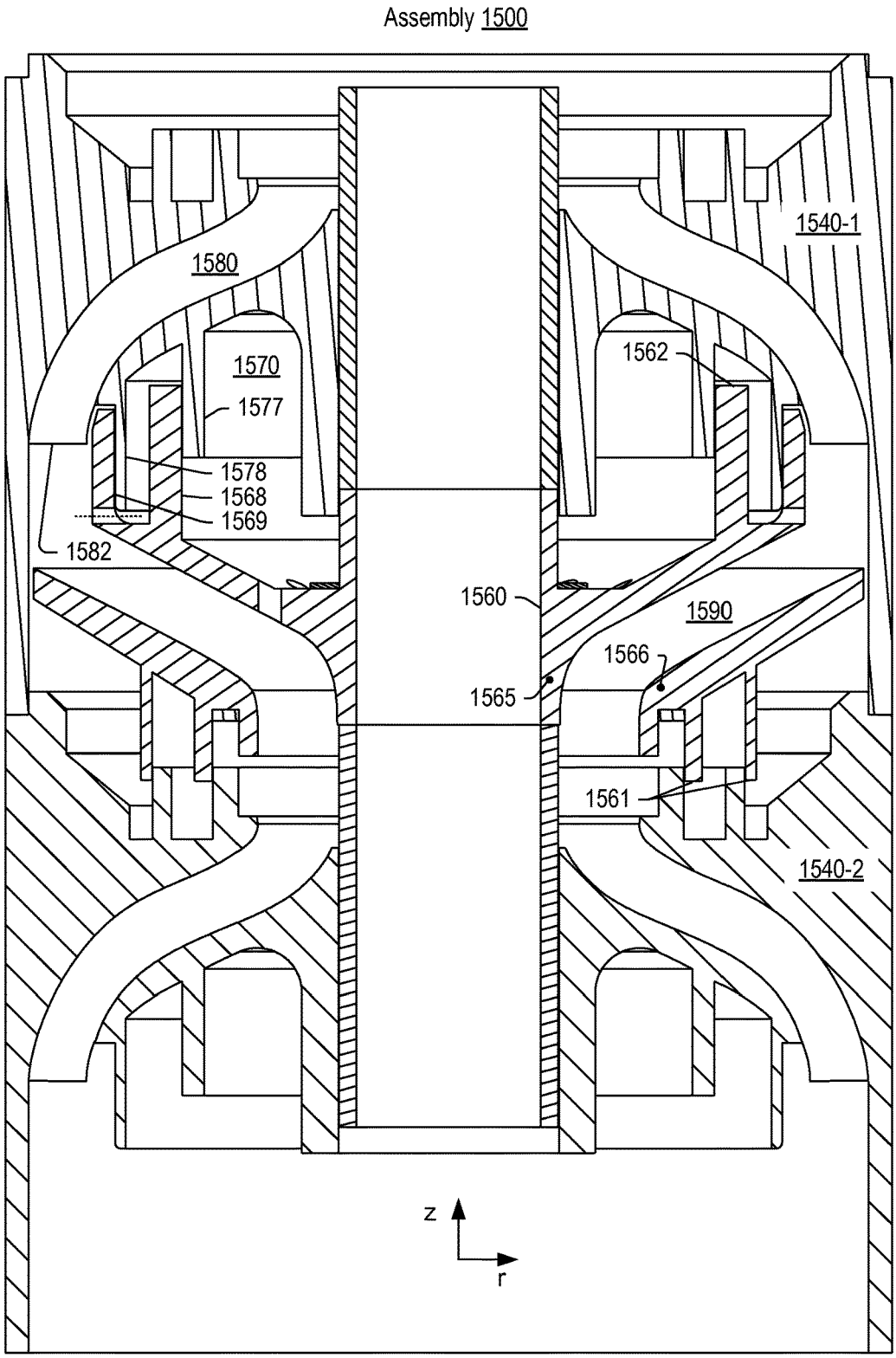
FIG. 15 illustrates an example of a portion of a pump.

FIG. 15 shows an example of an assembly 1500 that includes a first diffuser 1540-1, a second diffuser 1540-2 and an impeller 1560. In the example of FIG. 15, the diffuser 1540-1 includes an upper inner ring 1577 and an upper outer ring 1578 as well as a diffuser vane 1580 that includes a leading edge 1582 disposed at an axial position (e.g., with respect to a rotational axis of a shaft). As an example, the rings 1577 and 1578 may be integral to a hub portion of the diffuser 1540-1. For example, the upper outer ring 1578 may be a portion of a hub of the diffuser 1540-1 and may, for example, define, at least in part, an annular notch of the hub.

As shown in FIG. 15, the impeller 1560 includes a lower end 1561, an upper end 1562, a hub 1565 (e.g., a hub portion of the impeller 1560), a shroud 1566 (e.g., a shroud portion of the impeller 1560), an upper balance ring 1568 and an upper guard ring 1569; noting that FIG. 15 also shows a blade 1590 disposed at least in part between the hub 1565 and the shroud 1566. As shown, the upper balance ring 1568 can form a clearance with respect to a surface of the inner ring 1577 and the upper guard ring 1569 can form clearances with respect to a surface of the outer ring 1578 and a surface of the diffuser vane 1580 that is axially inset (e.g., above) the leading edge 1582 of the diffuser vane 1580. For example, an annular notch may be defined to exist between the outer ring 1578 and the diffuser vane 1580 in which at least a portion of the upper guard ring 1569 may be positioned and, for example, axially translate during various operational conditions. In such an example, additional clearances are introduced compared to the assembly 1200 of FIG. 12, which may, for example, hinder flow of particles radially inwardly to a chamber 1570.

In the example of FIG. 15, where a diffuser vane is extended (e.g., leading part of diffuser hub is "rotating" due to guard ring), such an approach may discourage sand from turning into a chamber (e.g., migrating toward a balance chamber).

As an example, a mixed-flow impeller for an electric submersible pump can include a lower end and an upper end; a hub that includes a through bore that defines an axis; blades that extend at least in part radially outward from the hub where each of the blades includes a leading edge and a trailing edge; an upper balance ring that includes a radially inward facing balance chamber surface and a radially outward facing diffuser clearance surface; and an upper guard ring disposed radially outwardly from the upper balance ring where the upper guard ring includes an axially facing diffuser clearance surface that is disposed axially between the trailing edges of the blades and the upper end. In such an example, the upper guard ring can include a radially inward facing chamber surface that defines at least a portion of a chamber intermediate the upper balance ring and the upper guard ring.

As an example, an upper balance ring of an impeller can include an axially facing surface that defines an upper end of the impeller. As an example, a hub of an impeller can include an axially facing surface that defines an upper end of the impeller. As an example, an upper end of an impeller can be an annular surface.

As an example, an impeller can include an axially facing diffuser clearance surface of an upper guard ring that includes an annular surface. As an example, an impeller can include an upper balance ring that has an axial span that exceeds an axial span of an upper guard ring of the impeller.

As an example, a hub of an impeller can include at least one balance passage that is located axially between leading edges and trailing edges of blades of the impeller.

As an example, a mixed-flow impeller can include an upper guard ring that includes at least one bleed hole. As an example, a bleed hole may be a passage, which may be of a particular length, cross-sectional area(s), etc. As an example, a bleed hole can extend between two surfaces of a guard ring, which may be surfaces of an annular wall. As an example, a bleed hole may be positioned in a manner whereby translation of features with respect to each other (e.g., a guard ring of an impeller with respect to a diffuser, etc.) may or may not block the bleed hole, for example, depending on dimensions of features (e.g., extent of axial translation, etc.).

As an example, a bleed hole (e.g., of a guard ring, etc.) may be of a dimension that is equal to or greater than a dimension of a particle or an average particle size, etc. For example, given particles of average size $D_P$, a bleed hole may include a cross-sectional dimension (e.g., a diameter, etc.) that exceeds $D_P$ (e.g., consider a multiplication factor such as $2*D_P$, $3*D_P$, etc.). As an example, a bleed hole may include an axis (e.g., a central axis) that is disposed radially, axially, or radially and axially. As an example, a guard ring may include bleed holes with a bleed hole configuration and other bleed holes with another, different bleed hole configuration. In such an example, the bleed hole configurations may be selected based at least in part on environmental conditions (e.g., type and amount of sand in fluid) and/or operational conditions (e.g., rotational speed, flow rate, etc.).

As an example, a mixed-flow impeller can include a lower balance ring and/or an upper balance ring. As an example, a mixed-flow impeller can include a lower guard ring and/or an upper guard ring.

As an example, a mixed-flow impeller for an electric submersible pump can include a lower end and an upper end; a hub that includes a through bore that defines an axis; a lower shroud ring that extends to a shroud wall; blades that extend at least in part radially outward from the hub to the shroud wall where each of the blades includes a leading edge and a trailing edge; a lower guard ring disposed radially outwardly from the lower shroud ring where the lower guard ring includes an axially facing diffuser clearance surface that is disposed axially between the leading edges of the blades and the lower end. In such an example, the impeller may include a lower balance ring that includes a radially inward facing chamber surface and a radially outward facing diffuser clearance surface where the lower guard ring is disposed radially outwardly from the lower balance ring. As an example, a lower guard ring can include one or more bleed holes (e.g., one or more passages).

As an example, a mixed-flow impeller and diffuser assembly for an electric submersible pump can include an impeller that includes a lower end and an upper end, a hub that includes a through bore that defines an axis, blades that extend at least in part radially outward from the hub where each of the blades includes a leading edge and a trailing edge, an upper balance ring that includes a radially inward facing balance chamber surface and a radially outward facing diffuser clearance surface, and an upper guard ring disposed radially outwardly from the upper balance ring where the upper guard ring includes an axially facing diffuser clearance surface that is disposed axially between the trailing edges of the blades and the upper end; and a diffuser that includes a lower end and an upper end, a hub that includes a through bore that defines an axis, and vanes that extend at least in part radially outward from the hub where each of the vanes includes a leading edge and a trailing edge. In such an example, the hub of the diffuser can include an annular notch that receives at least a portion of the upper guard ring. For example, at least a portion of the upper guard ring may be received in the annular notch between a portion of the hub of the diffuser and portions of the vanes of the diffuser.

As an example, as particles enter a clearance, where at least one surface defining the clearance is moving (e.g., rotating), the particles can cause wear in a manner that increases the clearance. Where such a clearance is associated with a balance chamber, pressure balancing by the balance chamber may be diminished, which, in turn, may have an effect on how a stage or stages of a pump handle axially directed forces (e.g., down thrust force, etc.). As an example, consider a clearance of the order of, for example, about hundredths of an inch being increased by, for example, several additional hundredths of an inch (see, e.g., sand sizes such as, for example, a Wentworth range from about 0.0049 inches to about 0.02 inches or more, etc.). In such an example, the clearance may more readily allow for flow of fluid, for example, into and/or out of a balance chamber, which may reduce the ability of the balance chamber to balance pressure forces.

As an example, a method may include operating an electric submersible pump by delivering power to an electric motor to rotate a shaft where impellers of a pump are operatively coupled to the shaft. In such an example, the method may include protecting the electric motor using a protector disposed axially between the pump and the electric motor.

As an example, one or more control modules (e.g., fora controller such as the controller 230, the controller 250, etc.) may be configured to control an ESP (e.g., a motor, etc.) based at least in part on information as to one or more fluid circuits in that may exist between stages of a pump. For example, one or more of backspin, sanding, flux, gas lock or other operation may be implemented in a manner that accounts for one or more fluid circuits (e.g., as provided by diffusers with fluid coupling holes). As an example, a controller may control an ESP based on one or more pressure estimations for a fluid circuit or circuits (e.g., during start up, transients, change in conditions, etc.), for example, where a fluid circuit or circuits may act to balance thrust force.

As an example, one or more methods described herein may include associated computer-readable storage media (CRM) blocks. Such blocks can include instructions suitable for execution by one or more processors (or cores) to instruct a computing device or system to perform one or more actions.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 16:
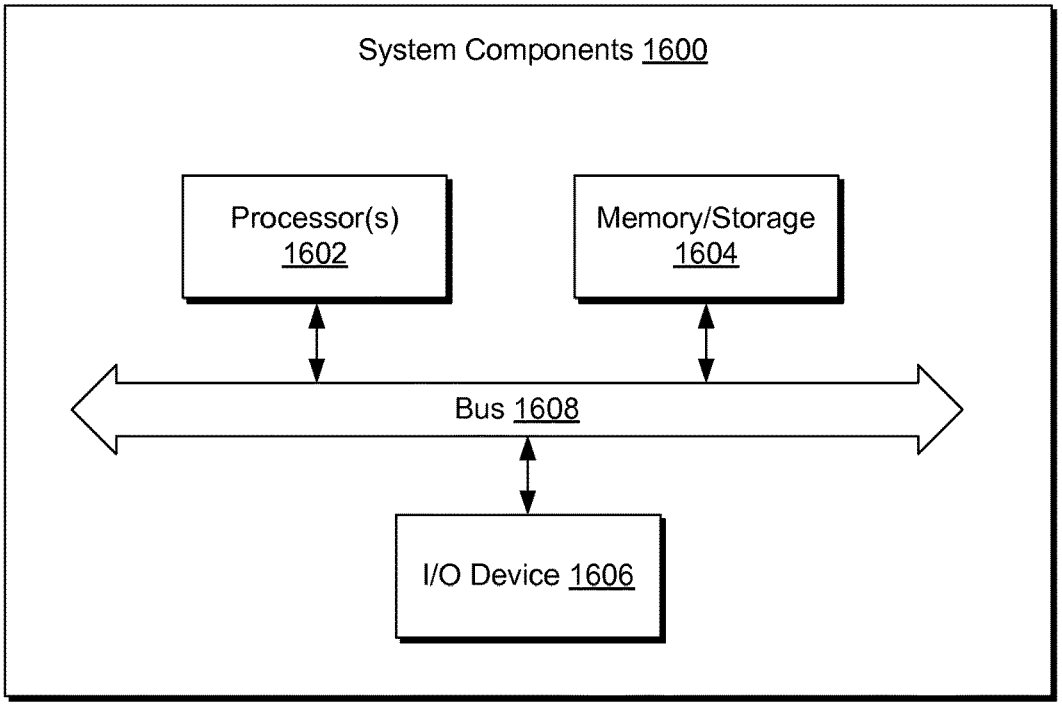
FIG. 16 illustrates example components of a system and a networked system.
Figure 16:
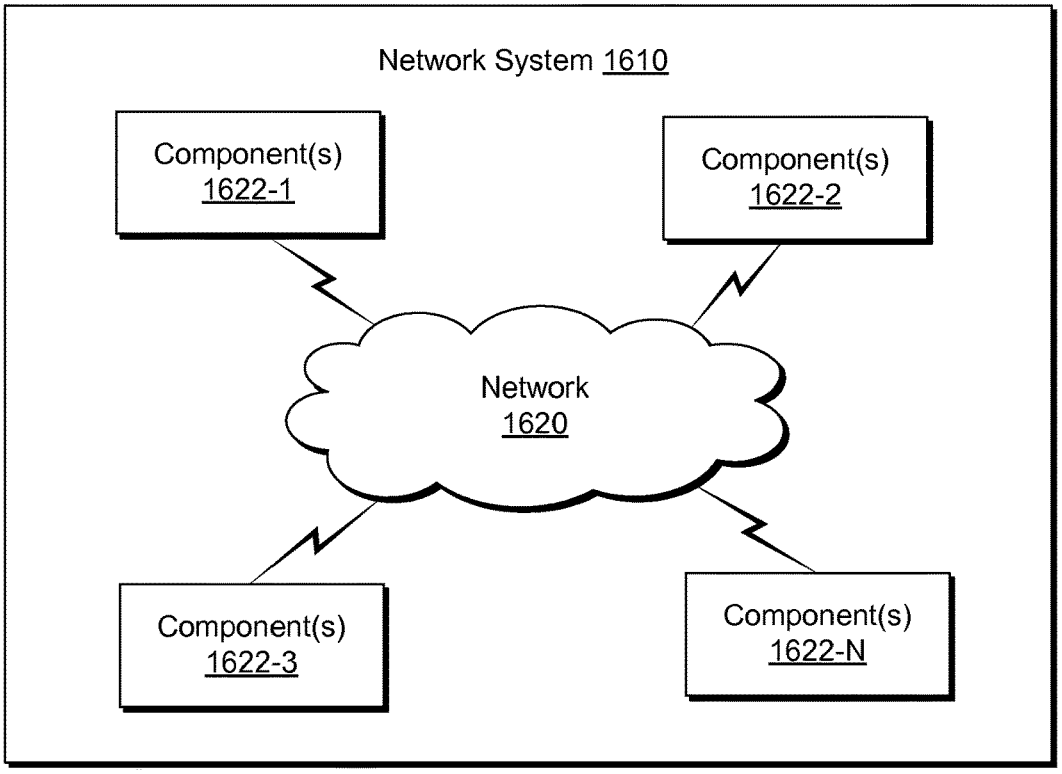

FIG. 16 shows components of a computing system 1600 and a networked system 1610. The system 1600 includes one or more processors 1602, memory and/or storage components 1604, one or more input and/or output devices 1606 and a bus 1608. According to an embodiment, instructions may be stored in one or more computer-readable media (e.g., memory/storage components 1604). Such instructions may be read by one or more processors (e.g., the processor(s) 1602) via a communication bus (e.g., the bus 1608), which may be wired or wireless. The one or more processors may execute such instructions to implement (wholly or in part) one or more attributes (e.g., as part of a method). A user may view output from and interact with a process via an I/O device (e.g., the device 1606). According to an embodiment, a computer-readable medium may be a storage component such as a physical memory storage device, for example, a chip, a chip on a package, a memory card, etc.

According to an embodiment, components may be distributed, such as in the network system 1610. The network system 1610 includes components 1622-1, 1622-2, 1622-3, . . . , 1622-N. For example, the components 1622-1 may include the processor(s) 1602 while the component(s) 1622-3 may include memory accessible by the processor(s) 1602. Further, the component(s) 1602-2 may include an I/O device for display and optionally interaction with a method. The network may be or include the Internet, an intranet, a cellular network, a satellite network, etc.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A mixed-flow impeller for an electric submersible pump, the mixed flow impeller comprising:

a lower end and an upper end, wherein in use, fluid flows through the mixed flow impeller in a direction such that the lower end is an upstream end and the upper end is a downstream end;

a hub that comprises a through bore that defines an axis;

blades that extend at least in part radially outward from the hub wherein each of the blades comprises a leading edge and a trailing edge;

an upper balance ring that comprises a radially inward facing balance chamber surface and a radially outward facing diffuser clearance surface; and an upper guard ring disposed radially outwardly from the upper balance ring and extending axially parallel to the upper balance ring, wherein the upper guard ring comprises an axially facing diffuser clearance surface that is disposed axially between the trailing edges of the blades and the upper end.

2. The mixed-flow impeller of claim 1 wherein the upper guard ring comprises a radially inward facing chamber surface that defines at least a portion of a chamber intermediate the upper balance ring and the upper guard ring.

3. The mixed-flow impeller of claim 1 wherein the upper balance ring comprises an axially facing surface that defines the upper end.

4. The mixed-flow impeller of claim 1 wherein the hub comprises an axially facing surface that defines the upper end.

5. The mixed-flow impeller of claim 1 wherein the upper end comprises an annular surface.

6. The mixed-flow impeller of claim 1 wherein the axially facing diffuser clearance surface of the upper guard ring comprises an annular surface.

7. The mixed-flow impeller of claim 1 wherein the upper balance ring comprises an axial span that exceeds an axial span of the upper guard ring.

8. The mixed-flow impeller of claim 1 wherein the hub comprise at least one balance passage that is located axially between the leading edges and the trailing edges of the blades.

9. The mixed-flow impeller of claim 1 wherein the upper guard ring comprises at least one bleed hole.

10. The mixed-flow impeller of claim 1 comprising a lower balance ring.

11. The mixed-flow impeller of claim 1 comprising a lower guard ring.

12. A mixed-flow impeller and diffuser assembly for an electric submersible pump, the assembly comprising:

an impeller that comprises a lower end and an upper end, the lower end being an upstream end and the upper end being a downstream end, a hub that comprises a through bore that defines an axis, blades that extend at least in part radially outward from the hub wherein each of the blades comprises a leading edge and a trailing edge, an upper balance ring that comprises a radially inward facing balance chamber surface and a radially outward facing diffuser clearance surface, and an upper guard ring disposed radially outwardly from the upper balance ring and extending axially parallel to the upper balance ring, wherein the upper guard ring comprises an axially facing diffuser clearance surface that is disposed axially between the trailing edges of the blades and the upper end; and a diffuser that comprises a lower end and an upper end, the lower end being an upstream end and the upper end being a downstream end, a hub that comprises a through bore that defines an axis, and vanes that extend at least in part radially outward from the hub wherein each of the vanes comprises a leading edge and a trailing edge.

13. The assembly of claim 12 wherein the hub of the diffuser comprises an annular notch that receives at least a portion of the upper guard ring.

14. The assembly of claim 13 wherein the at least a portion of the upper guard ring is received in the annular notch between a portion of the hub of the diffuser and portions of the vanes of the diffuser.

15. The assembly of claim 12 wherein the upper guard ring comprises at least one bleed hole.

16. The assembly of claim 12 wherein the impeller comprises a lower guard ring.

17. The assembly of claim 12, wherein the axially facing diffuser clearance surface of the upper guard ring is downstream facing, the assembly further comprising an axial clearance defined between the axially facing diffuser clearance surface of the upper guard ring and an axially facing and upstream facing clearance surface of a portion of the diffuser, and a radial clearance defined between the radially outward facing diffuser clearance surface of the upper balance ring and a radially inward facing surface of the portion of the diffuser.

* * * * *